US008093195B2

(12) United States Patent
Uhl et al.

(10) Patent No.: US 8,093,195 B2
(45) Date of Patent: Jan. 10, 2012

(54) COMPOSITION WITH SURFACE MODIFYING PROPERTIES

(75) Inventors: Stephan Uhl, Monheim (DE); Jacqueline Thöne, Düsseldorf (DE)

(73) Assignee: Ecolab USA Inc., St. Paul, MN (US)

( * ) Notice: Subject to any disclaimer, the term of this patent is extended or adjusted under 35 U.S.C. 154(b) by 100 days.

(21) Appl. No.: 12/093,203

(22) PCT Filed: Nov. 9, 2005

(86) PCT No.: PCT/EP2005/055866

§ 371 (c)(1), (2), (4) Date: Jul. 16, 2008

(87) PCT Pub. No.: WO2007/054126

PCT Pub. Date: May 18, 2007

(65) Prior Publication Data

US 2009/0007936 A1 Jan. 8, 2009

(51) Int. Cl.

| | |
|---|---|
| ***C11D 1/00*** | (2006.01) |
| ***C11D 3/02*** | (2006.01) |
| ***C11D 3/30*** | (2006.01) |
| ***C11D 3/32*** | (2006.01) |

(52) U.S. Cl. ..... 510/221; 510/229; 510/237; 510/421; 510/423; 510/424; 510/426; 510/475; 510/499; 510/501; 510/507; 510/508; 510/509; 510/511; 510/514

(58) Field of Classification Search ..... 510/221, 510/229, 237, 421, 423, 424, 426, 475, 499, 510/501, 507, 508, 509, 511, 514

See application file for complete search history.

(56) References Cited

U.S. PATENT DOCUMENTS

| | | | | |
|---|---|---|---|---|
| 2,407,895 | A | 9/1946 | Monson | |
| 2,674,619 | A | 4/1954 | Lundsted et al. | |
| 2,677,700 | A | 5/1954 | Jackson et al. | |
| 3,382,178 | A | 5/1968 | Lissant et al. | |
| 3,929,678 | A | 12/1975 | Laughlin | |
| 4,144,123 | A | 3/1979 | Scharf et al. | |
| 4,404,362 | A | 9/1983 | Bellos | |
| 4,459,220 | A | 7/1984 | Bellos | |
| 4,565,647 | A | 1/1986 | Llenado | |
| 6,569,261 | B1 * | 5/2003 | Aubay et al. | 134/39 |
| 6,846,512 | B2 | 1/2005 | Rohrbaugh et al. | |
| 2002/0172773 | A1 | 11/2002 | Ghosh et al. | |
| 2005/0239674 | A1 * | 10/2005 | Dreja et al. | 510/180 |

FOREIGN PATENT DOCUMENTS

| | | | |
|---|---|---|---|
| CA | 2555290 | * | 7/2006 |
| DE | 29 16 356 | | 11/1980 |
| EP | 0 025 515 | B1 | 7/1983 |
| EP | 1 215 276 | A1 | 6/2002 |
| WO | 01/05920 | | 1/2001 |
| WO | 02/070612 | A1 | 9/2002 |
| WO | 2004/055145 | A1 | 7/2004 |
| WO | 2005/073357 | A1 | 8/2005 |

OTHER PUBLICATIONS

English-language abstract for EP 1 215 276, (Jun. 2002).
English-language abstract for EP 0 025 515, (Jul. 1983).
English-language abstract for WO 2004/055145, (Jul. 2004).
English-language abstract for WO 2005/073357, (Aug. 2005).
English-language abstract for WO 01/05920, (Jan. 2001).

* cited by examiner

*Primary Examiner* — Gregory DelCotto
(74) *Attorney, Agent, or Firm* — Merchant & Gould P.C.

(57) ABSTRACT

The present invention refers to an aqueous composition comprising one or more amphoteric, organic polynitrogen-compounds having at least 3 nitrogen atoms contained in the molecule in the form of an amine and/or amide and one or more types of inorganic nanoparticles, a concentrate comprising said composition and to a method for treating and/or cleaning a surface which uses said composition.

16 Claims, No Drawings

COMPOSITION WITH SURFACE MODIFYING PROPERTIES

The present invention relates to an aqueous composition which may be applied in a method for cleaning and/or treating a surface, in particular a hard surface.

When cleaning or treating surfaces, in particular hard surfaces, besides a good cleaning performance it generally is desired to obtain the cleaned or treated surface with the lowest effort, in particular without the requirement to dry or polish it. Moreover, the cleaned or treated surface should not show any unfavorable residues remaining on the surface after the cleaning or treatment process like water spots, stripes or reams.

There are a lot of surfaces, often hard surfaces, which are regularly contacted with water in larger amounts or which are cleaned or treated very frequently, often several times a day, like surfaces (floors or walls) in public baths, in communal showers for example in companies, factories or gymnasiums. In a lower extent this also refers for example to a bathroom, and in particular the shower, or surfaces in the kitchen of a private household and even to the dishware in a dishwasher. In addition outdoor surfaces, and particularly windows, are also often contacted frequently with water, mainly in the form of rain or snow. It is desired that when cleaning or treating such surfaces and preferably also when the surface gets into contact with larger amounts of water after having finished the cleaning or treatment process, the surface should dry very fast, preferably even without further wiping, the occurrence of water spots after the drying should be minimized, in particular glass surfaces should be shining without stripes or reams and the re-soiling should be reduced combined with a facilitated cleaning in subsequent cleaning procedures.

The undesired residues remaining on the surface after its cleaning and drying may result from the soiling which originally has been on the surface, from the water used for cleaning like from the water hardness or contaminants dissolved in the water, from one or more components contained in the cleaning agent and/or from reaction products of any of the aforementioned sources.

In the state of the art several approaches are described to fulfill the above mentioned requirements. In particular it can be distinguished between a hydrophobizing and a hydrophilizing treatment of the surface and between a permanent or non-permanent treatment.

EP 1 215 276 A1 discloses washing and cleaning detergents comprising microdisperse, hydrophilic silicate containing particles preferably having a particle size of from 1 to 500 nm, and optionally comprising a hydrophobizing agent. The silicate containing particles are considered to form a surface coating which replaces the soiling on the surface and, thereby, are supposed to facilitate the cleaning and to reduce the re-soiling. The addition of hydrophobizing agents is supposed to improve the effect of the silicate containing particles, since a corresponding coating of the hydrophobizing agents enhances the soil removal and reduces the re-soiling.

U.S. Pat. No. 6,846,512 B2 points out that the water on such hydrophobically modified surfaces will bead up. However, it is believed that the beading of water may actually increase the formation of water spots since the beads of water will leave deposits on the surface when they dry. Therefore, this document discloses a composition imparting hydrophilizing properties to a surface and its application for cleaning and/or treating the surface of vehicles. The cleaning composition preferably comprises a polymer which is supposed to render the surface semi-durably hydrophilic which means the surface modification is maintained only for at least one rinse with water. In contrast thereto the treating composition comprises nanoparticles which show a longer lived effect.

A similar effect of nanoparticles is also described in US 2002/0172773 A1. This document refers to rinse aid surface coatings comprising a nanoparticle system and employing the same to impart surface modifying properties for all types of dishware surfaces in automatic dishwashing applications. The surface modification caused by the non-photoactive nanoparticle coating can produce durable, protective, long lasting or semi-permanent multi-use benefits. The surface coated with a layer of nanoparticles can be further provided with a further polymer layer applied thereupon which may impart for example hydrophilic or hydrophobic properties to the coated surface.

However, in particular long lasting and especially permanent effects caused by such coatings may be disadvantageous when the properties of the coatings change during use. If this is the case it might be very difficult to regain the original properties of the surface before application of the coating or even the initial properties of the coating. This is of particular relevance in case repeated application of the permanent coating does not result in the same properties of the coating as were achieved by the first coating.

WO 2004/055145 A1 also uses nanoparticles, namely colloidal silica sol, to impart hydrophilic properties to a surface, which are supposed to be semi-permanent, i.e. they occur for some weeks after the treatment of the surface, but are not permanent.

Although when using some of the above mentioned compositions a hydrophilization of the cleaned or treated surface may be achieved which results in an improved wetting of the treated surface and, therefore, in a reduced amount of water spots compared to the untreated surface, there still is a need to provide further compositions with a still improved drying performance, a reduced re-soiling and facilitated re-cleaning properties with an at least not deteriorated overall cleaning performance.

The above need is satisfied by providing an aqueous composition comprising one or more amphoteric, organic polynitrogen-compounds having at least 3 nitrogen atoms contained in the molecule in the form of an amine and/or amide and one or more types of nanoparticles on an inorganic basis.

Surprisingly, the inventor of the present invention have found out, that a combination of components as mentioned above leads to an improved performance compared to compositions in which at least one of the components are missing. Surfaces, and in particular hard surfaces, treated with a corresponding composition show an increased hydrophilicity of the surface. By the term "hydrophilicity" it is meant that the surface has a high affinity for water. Thus, treating or cleaning a surface with such a composition increases the affinity between water and the surface compared to the untreated surface. Thereby, water spreads out on the surface to maximize the contact, providing a water film on the surface which may run down on inclined surfaces.

Typically, the amount of liquid remaining on a hydrophobized surface is larger than the amount of liquid remaining on a hydrophilized surface. Thus, whereas, water beads forming on hydrophobized surfaces may result in lots of separated water spots after drying the, in most cases, the little residues which may remain on the surface resulting from a part of the water film which didn't run down are more continuous and attract less attention.

In addition, treating or cleaning a surface with the above specified composition results in a good overall cleaning performance and in a facilitated cleaning in the next cleaning procedure.

A main component in the composition according to the present invention represents one or more types of nanoparticles. Nanoparticles which are suitable for use in the present composition preferably have an average particle size of from 1 to 50 nm, preferably of from 2 to 40 nm and more preferred of from 4 to 20 nm.

The BET surface area for those particles preferably lies in the range of from 50 to 450, more preferred of from 200 to 400 and most preferred of from 300 to 380 $m^2/g$ (as determined according to DIN 66131).

In the composition according to the present invention the one or more types of nanoparticles preferably are selected from metal oxides, inorganic silicon compounds, carbonates and hydroxides.

Examples for suitable metal oxides representing suitable compounds for the formation of nanoparticles are aluminum oxide, zirconium oxide, titanium oxide, cerium oxide, zinc oxide and mixtures thereof.

However, it is preferred to select the one or more types of nanoparticles from the group comprising amorphous silicon dioxide, silicates, alumosilicates, silica sols, fumed silica or mixtures thereof.

Further suitable nanoparticles which may be used in the present invention are for example described in US 2002/0172773 A1. This document teaches that beside oxides, silicates, carbonates and hydroxides some layered clay minerals and inorganic metal oxides can be used as nanoparticles including hydrophilic surface properties.

The inorganic metal oxides can be exemplified by silica- or alumina-based nanoparticles that are naturally occurring or synthetic. Aluminum can be found in many naturally occurring sources, such as kaolinite and bauxite. The naturally occurring sources of alumina are processed by the Hall process or the Bayer process to yield the desired alumina type required. Various forms of alumina are commercially available in the form of Gibbsite, Diaspore, and Boehmite from manufactures such as Condea.

Suitable layered clay minerals include those in the geological classes of the smectites, the kaolins, the illites, the chlorites, the attapulgites and the mixed layer clays. Typical examples of specific clays belonging to these classes are the smectites, kaolins, illites, chlorites, attapulgites and mixed layer clays. Smectites, for example, include montmorillonite, bentonite, pyrophyllite, hectorite, saponite, sauconite, nontronite, talc, beidellite, volchonskoite and vermiculite. Kaolins include kaolinite, dickite, nacrite, antigorite, anauxite, halloysite, indellite and chrysotile. Illites include bravaisite, muscovite, paragonite, phlogopite and biotite. Chlorites include corrensite, penninite, donbassite, sudoite, pennine and clinochlore. Attapulgites include sepiolite and polygorskyte. Mixed layer clays include allevardite and vermiculitebiotite. Variants and isomorphic substitutions of these layered clay minerals offer unique applications.

The layered clay minerals may be either naturally occurring or synthetic. Natural or synthetic hectorites, montmorillonites and bentonites may as well be used as hectorites clays commercially available. Typical sources of commercial hectorites are the LAPONITES from Southern Clay Products, Inc., U.S.A.; Veegum Pro and Veegum F from R. T. Vanderbilt, U.S.A.; and the Barasyms, Macaloids and Propaloids from Baroid Division, National Read Comp., U.S.A.

Natural clay minerals which may be used typically exist as layered silicate minerals and less frequently as amorphous minerals. A layered silicate mineral has $SiO_4$ tetrahedral sheets arranged into a two-dimensional network structure. A 2:1 type layered silicate mineral has a laminated structure of several to several tens of silicate sheets having a three layered structure in which a magnesium octahedral sheet or an aluminum octahedral sheet is sandwiched between two sheets of silica tetrahedral sheets.

A sheet of an expandable layer silicate has a negative electric charge, and the electric charge may be neutralized by the existence of alkali metal cations and/or alkaline earth metal cations. Smectite or expandable mica can be dispersed in water to form a sol with thixotropic properties. Further, a complex variant of the smectite type clay can be formed by the reaction with various cationic organic or inorganic compounds. As an example of such an organic complex, an organophilic clay in which a dimethyldioctadecyl ammonium ion (a quaternary ammonium ion) may be introduced by cation exchange and has been industrially produced and used as a gellant of a coating.

As to synthetic clays, with appropriate process control, the processes for the production of synthetic nanoscale powders (i.e. synthetic clays) does indeed yield primary particles, which are nanoscale. However, the particles are not usually present in the form of discrete particles, but instead predominantly assume the form of agglomerates due to consolidation of the primary particles. Such agglomerates may reach diameters of several thousand nanometers, such that the desired characteristics associated with the nanoscale nature of the particles cannot be achieved. The particles may be deagglomerated, for example, by grinding as described in EP-A 637, 616 or by dispersion in a suitable carrier medium, such as water or water/alcohol and mixtures thereof.

An example of a suitable substituted variant of lithium magnesium silicate is where the hydroxyl group is partially substituted with fluorine. Lithium and magnesium may also be partially substituted by aluminum. In fact, the lithium magnesium silicate may be isomorphically substituted by any member selected from the group consisting of magnesium, aluminum, lithium, iron, chromium, zinc and mixtures thereof.

Synthetic hectorite is commercially marketed under the trade name LAPONITE™ by Southern Clay Products, Inc. There are many grades or variants and isomorphous substitutions of LAPONITE™ marketed. Examples of commercial hectorites are Lucentite SWN™, LAPONITE S™, LAPONITE XLS™, LAPONITE RD™, LAPONITE B™ and LAPONITE RDS™. LAPONITE XLS™ has the following characteristics: analysis (dry basis) $SiO_2$ 59.8%, MgO 27.2%, $Na_2O$ 4.4%, $Li_2O$ 0.8%, structural $H_2O$ 7.8%, with the addition of tetrasodium pyrophosphate (6%); specific gravity 2.53; bulk density 1.0. Generally LAPONITE™ has the formula:

$$[Mg_wLi_xSi_8O_{20}OH_{4-y}F_y]^{z-}$$

wherein w=3 to 6, x=0 to 3, y=0 to 4, z=12-2w-x, and the overall negative lattice charge may be balanced by counter-ions; and wherein the counter-ions are selected from the group consisting of selected $Na^+$, $K^+$, $NH_4^+$, $Cs^+$, $Li^+$, $Mg^{++}$, $Ca^{++}$, $Ba^{++}$, $N(CH_3)_4^+$ and mixtures thereof.

Fumed silica may also be used, preferably in powdered form, in the composition according to the present invention is also commercially available in the form of its nanoparticles like under the trade name AEROSIL® 90, 130, 150, 200, 300 and 380, supplied by Degussa However, in a particular preferred embodiment colloidal, nanoparticulate silica sols are contained in the composition according to the present invention. A colloidal nanoparticulate silica sol in the sense of the present invention represents a stable mainly aqueous dispersion of amorphous, particulate silicon dioxide $SiO_2$ having the above specified average particle sizes. This means that the particles are small enough that gravity doesn't cause them to settle, but large enough not to pass through a membrane.

Corresponding silica sol nanoparticles are commercially available, for example supplied by Eka Chemicals/Akzo under the trade name Bindzil® 30/360 having an average particle size of 9 nm. Further appropriate silica sols can be exemplified by Bindzil® 15/500, 30/220, 40/220, 305/220, which are all supplied by Eka Chemicals/Akzo, Nyacol® 215, 830, 1430, 2034DI and Nyacol® DP5820, DP5480, DP5540 and corresponding Nyacol® products, supplied by Nyacol® Products, Levasil® 100/30, 100F/30, 100S/30, 200/30, 200F/30, 300F/30, VP 4038, VP 4055, supplied by H.C. Starck/Bayer) as well as by CAB-O-Sperse® PG 001, PG 002 (aqueous dispersion of CAB-O-SIL® supplied by Cabot, Quarton PL-1, PL-3, supplied by FusoChemical Co., and Köstrosol 0830, 1030, 1430 supplied by Chemiewerk Bad Köstritz.

In some compositions it might be helpful to use a silica sol in which the surface of the colloidal silica nanoparticles is modified. Suitable modifications of the surface of the silica nanoparticles represent silanizing, an alumina-modification and a coating with aluminium oxide. The surface of colloidal silica particles typically is anionic at an alkaline pH level. It can be stabilized with cations like sodium or ammonium.

However, generally the presence of acids in a composition comprising colloidal silica sols leads to the formation of silica gels, which of course is not desired. Therefore, for use in acidic conditions silica sols may be used in which trivalent aluminium atoms are substituted for a part of the tetravalent silicon atoms in the surface of the particles. This creates a fixed negative charge which is independent of pH. Therefore, the stability of the alumina-modified sols will increase continuously with decreasing pH. Such modified silica sols are commercially available under the trade name Bindzil® 257/360 which is supplied by Akzo.

A coating of the silica nanoparticles with a layer of aluminium oxide converts the surface charge from negative to positive. Such cationic colloidal silicas typically are colloidal dispersions of discrete spherical silica particles in weakly acidic water. The interior of the particles preferably is mainly formed of pure amorphous silicon dioxide. The surface of the particles is modified with inorganic compounds like aluminium oxide to give them a cationic surface charge. Such modified silica sols are commercially available under the trade name Bindzil® CAT, CAT 220 and CAT 80 which are all supplied by Akzo.

Further suitable silica sols having a silica surface modification represent a silica sol in which the surface of the silica particles is silanized. Corresponding silica sols generally have a silica content of at least 20 wt. % based on the total sol and a weight ratio of silane to silica of from 0.003 to about 2. Suitable silanes for modifying the surface of the silica particles are exemplified by tris-(trimethoxy) silane, octyl triethoxysilane, methyl triethoxysilane, methyl trimethoxysilane; isocyanate silane such astris-[3-(trimethoxysilyl) propyl] isocyanurate; gamma-mercaptopropyltrimethoxysilane, bis-(3-[triethoxysilyl]propyl) polysulfide, beta-(3,4-epoxycyclohexyl)-ethyl trimethoxysilane; silanes containing an epoxy group (epoxy silane), glycidoxy and/or a glycidoxypropyl group such as gamma-glycidoxypropyl trimethoxysilane, gamma-glycidoxypropylmethyldiethoxysilane, (3-glycidoxypropyl) trimethoxy silane, (3-glycidoxypropyl) hexyltrimethoxysilane, beta-(3,4-epoxycyclohexyl)-ethyltriethoxysilane; silanes containing a vinyl group such as vinyltriethoxysilane, vinyl trimethoxysilane, vinyl tris-(2-methoxyethoxy)silane, vinyl methyldimethoxysilane, vinyl triisopropoxysilane; gamma-methacryloxypropyl trimethoxysilane, gamma-methacryloxypropyl triisopropoxysilane, gamma-methacryloxypropyl triethoxysilane, octyltrimethyloxy silane, ethyltrimethoxy silane, propyltriethoxy silane, phenyltrimethoxy silane, 3-mercaptopropyltriethoxy silane, cyclohexyltrimethoxy silane, cyclohexyltriethoxy silane, dimethyldimethyoxy silane, 3-chloropropyltriethoxy silane, 3-methacryoxypropyltrimethoxy silane, i-butyltriethoxy silane, trimethylethoxy silane, phenyldimethylethoxy silane, hexamethyidisiloxane, trimethylsilyl chloride, vinyltriethoxy silane, hexamethyldisilizane, and mixtures thereof. U.S. Pat. No. 4,927,749 discloses further suitable silanes which may be used in the present invention. The most preferred silanes, however, are epoxy silanes and silanes containing a glycidoxy or glycidoxypropyl group, particularly gamma-glycidoxypropyltrimethoxysilane and/or gamma glycidoxypropyltmethyldiethoxysilane.

Such silane-modified silica sols are commercially available from Eka Chemicals/Akzo under the trade name Bindzil® CC30 and CC40, with an average particle size of 7 nm and 12 nm, respectively.

Although it is also possible to use a mixture of any of the above described types of nanoparticles, like a combination of nanoparticles of the Laponite™ type and a colloidal silica sol, for example, and also of various nanoparticles of the same type, like a mixture of several Bindzil® silica sols, for example, it is most preferred to use only one type of nanoparticles and with no variation within this type.

The one or more inorganic nanoparticles are preferably contained in a total amount of from 0.01 to 3 wt. %, preferably of from 0.1 to 1.5 wt. %, more preferred of from 0.3 to 0.7 wt. % and most preferred of from 0.5 to 0.6 wt. % based on the total composition. Analogous to what was mentioned before the amounts refer to the amounts of the active substance. In case commercially available products are employed which are diluted for example with water this has to be taken into account. Moreover the amounts refer to the end use composition. This especially should be born in mind in case a concentrate is prepared and not the use solution.

As to the concentrate the nanoparticles preferably are contained therein in a total amount of from 0.05 to 15 wt. %, preferably of from 0.5 to 10 wt. % and more preferred of from 1.2 to 6 wt. %.

The third group of the main components of the composition according to the pre-sent invention represents the amphoteric organic polynitrogen-compound. Organic polynitrogen compound in the sense of the present invention means an organic compound comprising at least 3 nitrogen atoms which are contained in the molecule in the form of an amine, like a primary, a secondary or a teriary amine, and/or in the form of an amide. By amphoteric is meant that the same compound may function as acceptor as well as a donator for protons.

Suitable functional groups imparting proton donator properties represent carboxy residues or derivatives thereof, like amides, anhydrides or esters, as well as salts thereof, like alkali salts, for example sodium or potassium salts, or ammonium salts, which may be converted into the carboxy group.

Depending on the size of the polynitrogen moiety there may be one or more proton donating functionalities in the molecule. It is preferred that more than one proton donating functionalities are present in the amphoteric polynitrogen compound.

In a preferred embodiment the amphoteric organic polynitrogen compound is a polymeric amphoteric organic polynitrogen-compound. This means it preferably has an average molecular weight of at least 300.

The one or more amphoteric organic polynitrogen compounds preferably are independently obtainable from reacting Polyalkylene polyamines, polyamidoamines, ethyleneimine-grafted polyamidoamides, polyetheramines or mixtures thereof as component A optionally with at least bi-functional cross-linking agents having a functional group independently selected from a halohydrin, a glycidyl, an aziridine or an isocyanate moiety or a halogen atom, as component B, and with monoethylenically unsaturated carboxylic acids; salts, esters, amides or nitriles of monorethylenically unsaturated carboxylic acids; salts, esters, amides or nitriles of monoethylenically unsaturated carboxylic acids, chlorocarboxylic acids and/or glycidyl compounds like glycidyl acid, glycidyl amide or glycidyl esters.

Those compounds are described for example in WO 2005/073357 A2. The amphoteric organic polynitrogen compounds are obtainable by reacting components A, optionally with B and with C. The compound therefore can be present in cross-linked or uncross-linked form, wherein component A in any case is modified with component C.

Components A, optionally B and C may be used in any possible ratio. If component B is employed, preferably components A and B are used in a molar ratio of from 100:1 to 1:1000, more preferred of from 20:1 to 1:20. The molar ratio of components A and C preferably is chosen such that the molar ratio of the hydrogen atoms bonded to the nitrogen in A and component C is from 1:0.2 to 1:0.95, more preferred from 1:0.3 to 1:0.9, and even more preferred from 1:0.4 to 1:0.85.

Component A

Suitable compounds as component A represent polyalkylene polyamines. Herein polyalkylene polyamines are meant to refer to compounds comprising at least 3 nitrogen atoms, like diethylenetriamine, triethylenetetraamine, tetraethylenepentaamine, pentaethylenehexamine, diaminopropylenediamine, trisaminopropylamine and polyethyleneimine. Polyethyleneimines preferably have an average molecular weight ($M_w$) of at least 300. It is particularly preferred that the average molecular weight of the polyethyleneimines ranges from 800 to 2,000,000, more preferred from 20,000 to 1,000,000, and even more preferred from 20,000 to 750,000, as determined by means of light scattering.

The polyethyleneimines may be partially amidated. Products of this kind are obtainable by reacting polyalkylene polyamines with carboxylic acids, carboxylic acid esters, carboxylic acid anhydrides or acylhalides. The polyalkylene polyamines as suitable in the present invention preferably are amidated to an extent of 1 to 30, more preferred of up to 20% for the subsequent reactions. The amidated polyalkylene polyamines are required to contain free NH-groups in order to let them react with compounds B and C. Suitable carboxylic acids which may be used to amidate the polyalkylene polyamines are exemplified by $C_1$-$C_{28}$ carboxylic acids, like formic acid, acetic acid, propionic acid, benzoic acid, lauric acid, palmitic acid, stearic acid, oleic acid, linoleic acid and behenic acid. It is also possible to amidate by reacting the polyalkylene polyamine with alkyldiketene.

Moreover, the polyalkylene polyamines may be used partly in quaternized form as component A. Suitable quaternization agents represent for example alkyl halides, like methyl chloride, ethyl chloride, butyl chloride, epichlorohydrin, hexyl chloride, dimethyl sulfate, diethyl sulfate and benzyl chloride. If quaternized polyalkyleneamines are used as component A the degree of quaternization preferably is 1 to 30, more preferred up to 20%.

Further compounds which are appropriate as component A are polyamidoamines. Polyamidoamines are obtainable, for example, by reacting $C_4$-$C_{10}$ dicarboxylic acids with polyalkylene polyamines containing preferably 3 to 10 alkaline nitrogen atoms. Suitable dicarboxylic acids can be exemplified by succinic acid, maleic acid, adipic acid, glutaric acid, suberic acid, sebacic acid and terephthalic acid. It is also possible to use mixtures of carboxylic acids, like a mixture of adipic acid and glutaric acid, or maleic acid and adipic acid. Preferably adipic acid is used to produce the polyamidoamines. Suitable polyalkylene polyamines which may be condensed with the dicarboxylic acids are similar to the ones mentioned above, and can be exemplified by diethylenetriamine, triethylenetetraamine, dipropylenetriamine, tripropylenetetraamine, dihexamethylenetriamine, aminopropyl ethylenediamine and bis-aminopropyl ethylenediamine. Mixtures of polyalkylene polyamines may also be used to prepare polyamidoamines. Preferably the preparation of the polyamidoamines takes place in substance, however optionally the preparation can be carried out in inert solvents. The condensation reaction of the dicarboxylic acids with the polyalkylene polyamines is carried out at elevated temperatures like in the range of from 120 to 220° C. The water formed during the reaction is distilled off the reaction mixture. Lactones or lactams derivable from carboxylic acids having 4 to 8 carbon atoms also may be present during the condensation reaction. Generally, 0.8 to 1.4 mole of polyalkyleneamines are used with each mole of dicarboxylic acid. The thus obtained polyamidoamines have primary and secondary NH-groups and are soluble in water.

A further compound which is suitable as component A represents a nethyleneimine-grafted polyamidoamine. Such products are obtainable by reacting ethyleneimine with the above described polyamidoamines in the presence of Brönstedt-acids or Lewis-acids, like sulfuric acid, phosphoric acid or boron trifluoride etherate. Those conditions result in a graft of ethyleneimine to the polyamidoamine. For example each alkaline nitrogen group of the polyamidoamine may be grafted with 1 to 10 ethyleneimine units, i.e. 10 to 500 parts by weight of ethyleneimine are used with 100 parts by weight of a polyamidoamine.

In addition polyetheramines represent appropriate compounds as component A. Such compounds are known for example from DE-A 29 16 356. Polyetheramines are obtainable from condensing diamines and polyamines with chlorohydrin ethers at elevated temperatures. The polyamines may comprise up to 10 nitrogen atoms. The chlorohydrin ethers themselves can be prepared for example by reacting a dihydric alcohol having 2 to 5 carbon atoms, the alkoxylation products thereof having up to 60 alkyleneoxide units, glycerol or polyglycerol comprising up to 15 glycerol units, erythritol or pentaerythritol with epichlorohydrin. At least 2 to 8 moles of epichlorohydrin are reacted with each mole of said alcohol. The reaction of the diamines and the polyamines on one hand and the chlorohydrin ethers on the other hand generally takes place at temperatures of from 1 to 200° C., preferably of from 110 to 200° C. Moreover, polyetherpolyamines may be prepared by condensing diethanolamine or triethanolamine according to the methods known in the art, as the ones disclosed in U.S. Pat. No. 4,404,362, U.S. Pat. No. 4,459,220 and U.S. Pat. No. 2,407,895.

It is particularly preferred to use polyalkylene polyamines as component A, which optionally are amidated to a degree of 20% at most. More preferred compounds represent polyalkylene polyamines, especially polyethyleneimines, which have an average molecular weight of from 800 to 2,000,000, more preferred of from 200,000 to 1,000,000, and most preferred of from 20,000 to 750,000 in a particularly advantageous embodiment.

Component B

Suitable compounds for use as component B represent bifunctional cross-linking agents comprising halohydrin units, glycidyl units, aziridine units or isocyanate units or a halogen atom as functional groups.

Suitable cross-linking agents can be exemplified by epihalohydrin, preferably epichlorohydrin, as well as α,ω-bis-(chlorohydrin) polyalkylene glycol ether and the α,ω-bis-(epoxides) of polyalkylene glycol ethers which are obtainable therefrom by treatment with bases. The chlorohydrinethers may be prepared, for example, by reacting polyalkylene glycols with epichlorohydrin in a molar ratio of 1 to at least 2 to 5. Appropriate polyalkylene glycols represent polyethylene glycol, polypropylene glycol and polybutylene glycol as well as block copolymers of $C_2$- to $C_4$ alkyleneoxides. The average molecular weight ($M_w$) of the polyalkylene glycols generally ranges from 100 to 6000, preferably from 300 to 2000 g/mol. α,ω-bis(chlorohydrin) polyalkylene glycol ether are for example described in U.S. Pat. No. 4,144,123. This document also discloses that the corresponding bisglycidylethers of the polyalkylene glycols result from dichlorohydrinethers by treatment with bases.

Moreover, α,ω-dichloropolyalkylene glycols are suitable as cross-linking agents, like the ones disclosed in EP-A 0 025 515. Those α,ω-dichloropolyalkylene glycols are obtainable by reacting dihydric to tetrahydric alcohols, preferably alkoxylated dihydric to tetrahydric alcohols either with thionyl chloride resulting in a cleavage of HCl followed by catalytic decomposition of the chlorosulfonated compound while eliminating sulfur dioxide, or with phosgene resulting in the corresponding bischlorocarbonic acid ester while eliminating HCl, which bischlorocarbonic acid esters are catalytically decomposed eliminating carbondioxid to result in α,ω-dichloro ether.

Preferably the dihydric to tetrahydric alcohols are ethoxylated and/or propoxylated glycols wherein each mole of glycol is reacted with 1 to 100, in particular with 4 to 40 moles of ethylene oxide.

α,ω- or vicinal dichloroalkanes, like 1,2-dichloroethane, 1,2-dichloropropane, 1,3-dichloropropane, 1,4-dichlorobutane and 1,6-dichlorohexane represent other appropriate cross-linking agents. It is also possible to use cross-linking agents which are obtainable from reacting at least trihydric alcohols with epichlorohydrin, resulting in reaction products having at least two chlorohydrin-moieties. Examples for polyhydric alcohols are glycerol, ethoxylated or propoxylated glycerol, polyglycerol having 2 to 15 glycerol units within the molecule and optionally ethoxylated and/or propoxylated polyglycerol. Cross-linking agents of t his kind are known for example from DE-A 29 16 356. Other appropriate cross-linking agents represent cross-linking agents containing blocked isocyanate groups for example trimethylhexamethylene diisocyanate blocked with 2,2,3,6-tetramethylpiperidone-4. Such cross-linking agents are known for example from DE-A 40 28 285. Moreover, cross-linking agents based on polyethers or substituted hydrocarbons containing aziridine moieties like 1,6-bis-N-aziridinohexane are suitable as cross-linking agents. According to the present invention the cross-linking agents may be employed individually or as a mixture of two or more cross-linking agents.

It is particularly preferred to use epihalohydrins, especially epichlorohydrin, α,ωbis-(chlorohydrin) polyalkylene glycol ether, α,ω-bis-(epoxides) of polyalkylene glycol ethers and/or bisglycidylethers of polyalkylene glycols as component B.

Component C

Examples for compounds suitable as component C represent monoethylenically unsaturated carboxylic acids having preferably 3 to 18 carbon atoms in their alkenyl residue. Appropriate monoethylenically unsaturated carboxylic acids include by acrylic acid, methacrylic acid, diemethacrylic acid, ethyl acrylic acid, allyl acetic acid, vinyl acetic acid, maleic acid, fumaric acid, itaconic acid, methylene malonic acid, oleic acid and linoleic acid. Monoethylenically unsaturated carboxylic acids selected from the group comprising acrylic acid, methacrylic acid and maleic acid are especially preferred.

It is also possible to use the salts of the aforementioned monoethylenically unsaturated carboxylic acids as component C. Suitable salts generally represent alkali metal, alkaline earth metal and ammonium salts of the aforementioned acids. Particularly preferred are sodium, potassium and ammonium salts. Ammonium salts can be derived from ammonia as well as from amines or amine derivatives like ethanolamine, diethanolamine and triethanolamine. Examples for alkaline earth metal salts generally represent magnesium and calcium salts of the aforementioned monoethylenically unsaturated carboxylic acids.

Suitable esters of the aforementioned monoethylenically unsaturated carboxylic acids are derivable from monohydric $C_1$-$C_{20}$ alcohols or from dihydric $C_2$-$C_6$ alcohols. Esters which may be used herein can be exemplified by methyl acrylate, ethyl acrylate, n-propyl acrylate, isopropyl acrylate, n-butyl acrylate, isobutyl acrylate, methyl methacrylate, ethyl methacrylate, isopropyl methacrylate, n-butyl methacrylate, 2-ethylhexyl acrylate, 2-ethylhexyl methacrylate, palmityl acrylate, lauryl acrylate, diaryl acrylate, lauryl methacrylate, palmityl methacrylate, stearyl methacrylate, dimethyl maleate, diethyl maleate, isopropyl maleate, 2-hydroxyethyl acrylate, 2-hydroxyethyl methacrylate, 2-hydroxypropyl acrylate, 3-hydroxypropyl acrylate, 2-hydroxypropyl methacrylate, 3-hydroxypropyl methacrylate, hydroxybutyl acrylate, hydroxybutyl methacrylate and hydroxyhexyl acrylate and hydroxyhexyl methacrylate.

Acrylamide, methacrylamide and oleic amide represent appropriate amides of monoethylenically unsaturated carboxylic acids. Suitable nitriles of the monoethylenically unsaturated carboxylic acids are acrylonitrile and methacrylonitrile. It is also possible to use amides which are derivable by reacting monoethylenically unsaturated carboxylic acids, in particular (meth)acrylic acid, with amidoalkane sulfonic acids. Those amides are especially advantageous which are obtainable from reacting monoethylenically unsaturated carboxylic acids, especially (meth)acrylic acid, with amidoalkane sulfonic acids, as represented by formulae I or II:

$$H_2C{=}CH{-}X{-}SO_3H \quad (I)$$

$$H_2C{=}C(CH_3){-}X{-}SO_3H \quad (II)$$

wherein X either is not present or a spacing group of the formulae —C(O)—NH—$CH_2$—$_n(CH_3)_n(CH_2)_m$—, —C(O)NH—, —C(O)—NH—($CH(CH_3)CH_2$)— or —C(O)—NH—$CH(CH_2CH_3)$—, with n being 0 to 2 and m being 0 to 3. Particularly preferred are 1-acrylamido-1-propanesulfonic acid (X=—C(O)—NH—$CH(CH_2CH_3)$— in formula I), 2-acrylamido-1-propanesulfonic acid (X=(O)—NH—($CH(CH_3)CH_2$)— in formula I), 2-acrylamido-2-methyl-1-propanesulfonic acid (—C(O)—NH—$C(CH_3)_2(CH_2)$— in formula I), 2-methacrylamido-2-methyl-1-propanesulfonic acid (X=—C(O)—NH—$C(CH_3)_2(CH_2)$— in formula II) and vinylsulfonic acid (X not present in formula I).

Moreover chlorocarboxylic acids are appropriate as component C. Such chlorocarboxylic acids include chloroacetic acid, 2-chloropropionic acid, 2-chlorobutanoic acid, dichloroacetic acid and 2,2'-dichloro propionic acid.

Further compounds suitable as component C are glycidyl compounds which are represented by the following formula:

(III)

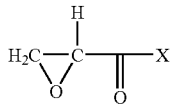

wherein

X $NH_2$, OMe, OR

Me H, Na, K, ammonium and

R $C_1$-$C_4$ alkyl or $C_2$-$C_4$ hydroxyalkyl.

Preferred compounds of formula III represent glycidyl acid, sodium, potassium, ammonium, magnesium or calcium salts thereof, glycidyl amide and glycidyl ester like glycidyl methyl ester, glycidyl ethyl ester, glycidyl n-propyl ester, glycidyl n-butyl ester, glycidyl iso-butyl ester, glycidyl-2-ethylhexyl ester, glycidyl-2-hydroxypropyl ester and glycidyl-4-hydroxybutyl ester. Glycidyl acid and sodium, potassium or ammonium salts thereof or glycidyl amide are particularly preferred.

It is particularly advantageous to use a monoethylenically unsaturated carboxylic acid as component C, especially acrylic acid, methacrylic acid or maleic acid, and more preferred acrylic acid.

The above described preferred amphoteric organic polynitrogen compounds can be produced according to methods known in the art. Suitable methods of production are disclosed for example in DE-A 42 44 194, in which component A at first reacts with component C and afterwards component B is added. According to DE-A 42 44 194 it is also possible to have components C and B reacted simultaneously with component A.

In a preferred embodiment the amphoteric organic polynitrogen compounds comprising components A, B and C are prepared using a method comprising the steps:

i) cross-linking of polyalkylene polyamines, polyamidoamines, ethyleneimine-grafted polyaminoamides, polyetheramines or mixtures thereof as component A with at least bifunctional cross-linking agents having a functional group independently selected from a halohydrin, a glycidyl, an aziridine or an isocyanate moiety or a halogen atom, as component B, and j) reacting the product obtained in step i) with monoethylenically unsaturated carboxylic acids; salts, esters, amides or nitriles of monoethylenically unsaturated carboxylic acids, chlorocarboxylic acids and/or glycidyl compounds like glycidyl acid, glycidyl amide or glycidyl esters as component C.

Step i)

The cross-linking of the compounds exemplified for component A with the cross-linking agents C proceeds according to methods known to the skilled person. Generally, the cross-linking is carried out at a temperature of from 10 to 200° C., preferably of from 30 to 100° C. and typically at standard pressure. The reaction times depend on the used components A and B and in most cases range from 0.5 to 20 hours, preferably from 1 to 10 hours. In general, curing component B is added in the form of an aqueous solution to have the reaction take place in aqueous solution as well. The product obtained can be isolated or directly used in step j) without further isolation which is preferred.

Step j)

In step j) the product obtained in step i) is reacted with the compound according to group C. If the compound of group C comprises a monoethylenically unsaturated compound having a double bonding system the primary or secondary amine groups of the cross-linked product obtained in step i) are added to the free end of the double bond similar to a Michael-addition. If the compound of group C is a chlorocarboxylic acid or a glycidyl compound of formula I the reaction of the amine moieties proceeds at the chloro group or the epoxy group. The reaction typically is carried out at a temperature of from 10 to 200° C., preferably of from 30 to 100° C. and usually at standard pressure. The reaction time depends on the components used and generally lies within the range of from 0.5 to 100 hours, preferably from 1 to 50 hours.

It is common to carry out the reaction in an aqueous solution wherein the product obtained in step i) already is present in an aqueous solution.

Specific examples for the preparation of such compounds are also described in WO 2005/073357 A2.

One particularly preferred compound of the amphoteric organic polynitrogen compounds as specified above, which may be used in the composition of the present invention is commercially available under the trade name Sokalan® HP70, supplied by BASF.

Preferably the one or more amphoteric organic polynitrogen compounds are contained in the composition in a total amount of from 0.01 to 3 wt. %, preferably of from 0.1 to 1.5 wt. %, more preferred of from 0.3 to 0.7 wt. % and most preferred of from 0.5 to 0.6 wt. % based on the total end use composition. Those amounts refer to the amount of the active substance. In case commercially available products are employed which are diluted for example with water this has to be taken into account. Moreover the amounts refer to the end use composition. This especially should be born in mind in case a concentrate is prepared and not the use solution directly.

As to the concentrate the one or more amphoteric organic polynitrogen compounds preferably are contained therein in a total amount of from 0.05 to 15 wt. %, preferably of from 0.5 to 10 wt. % and more preferred of from 1.2 to 6 wt. %.

Without being bound to this theory it is assumed that the one or more amphoteric organic polynitrogen compounds provide some kind of adhesion between the nanoparticles and the surface to be treated and/or cleaned. This theory is strengthened by the observation that the surface micro-roughness of the surface to be treated or cleaned is increased after its treatment or cleaning. With surface micro-roughness is meant the number which equals the mean deviation of the surface protrusions from a hypothetical perfect surface. Generally, the surface micro-roughness is determined by means of atomic force microscopy (AFM) and is measured in nm or μm. After having used the composition according the present invention the surface micro-roughness generally is increased by 3 to 50 nm. Said increase approximately corresponds to the average particle size of the nanoparticles used and is independent from the surface micro-roughness present before having treated the surface with the composition of the present invention. This indicates that at least some of the nanoparticles are present on the outer surface, probably embedded in the one or more amphoteric organic polynitrogen compounds which are at least to some extent coated on the surface. Therefore, the use of the amphoteric organic polynitrogen compounds is considered to help to control the rinses with water or other liquids partly or completely dissolving the polynitrogen compounds or the number of treatments after which the nanoparticles still adhere or no longer adhere to the treated surface. Thus, the selection of the amphoteric organic polynitrogen compound is supposed to influence whether or not a non-permanent adhesion is obtained.

Depending on the intended use of the composition it may be of advantage if the composition additionally comprises one or more surfactants. The presence of surfactants in the composition according to the present invention improves the wetting of the surface to be cleaned with the present composition. Those one or more surfactants used in the composition according to the present invention can be independently selected from anionic, nonionic, cationic, amphoteric and zwitterionic surfactants.

The use of the surfactants may vary depending on the intended field of application. However, in one preferred embodiment, in particular for cleaning glass or ceramic, tiles or similar materials, only one or more anionic surfactants, one or more nonionic surfactants or mixtures thereof are used.

In case the pH value of the composition is below 7, as is usually the case for example in bath cleaners, it turned out to be particularly advantageous if the composition does not contain any anionic surfactants but only one or more nonionic surfactants.

Preferably the composition according to the present invention comprises at least one nonionic surfactant selected from the group of semi-polar nonionic surfactants. Generally, semi-polar nonionics are high foamers and foam stabilizers. The semi-polar nonionic surfactants include the amine oxides, phosphine oxides, sulfoxides and their alkoxylated derivatives.

Amine oxides preferably are tertiary amine oxides corresponding to the general formula:

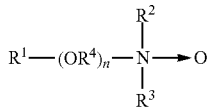

(IV)

wherein the arrow is a conventional representation of a semi-polar bond; and $R^1$, $R^2$, and $R^3$ may be aliphatic, aromatic, heterocyclic, alicyclic, or combinations thereof. Generally, for amine oxides of detergent interest, $R^1$ is an alkyl radical of from 8 to 24 carbon atoms; $R^2$ and $R^3$ are alkyl or hydroxyalkyl of 1-3 carbon atoms or a mixture thereof; $R^2$ and $R^3$ can be attached to each other, e.g. through an oxygen or nitrogen atom, to form a ring structure; $R^4$ is an alkylene or a hydroxyalkylene group containing 2 to 3 carbon atoms; and n ranges from 0 to 20.

Useful water soluble amine oxide surfactants are selected from the coconut or tallow alkyl di-(lower alkyl) amine oxides, specific examples of which are decyldimethylamine oxide, dodecyldimethylamine oxide, tridecyldimethylamine oxide, tetradecyldimethylamine oxide, pentadecyldimethylamine oxide, hexadecyldimethylamine oxide, heptadecyldimethylamine oxide, octadecyldimethylamine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl)amine oxide, 3,6,9-trioctadecyldimethylamine oxide and 3-dodecoxy-2-hydroxypropyldi-(2-hydroxyethyl)amine oxide.

Useful semi-polar nonionic surfactants also include the water soluble phosphine oxides having the following structure:

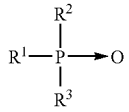

(V)

wherein the arrow is a conventional representation of a semi-polar bond; and $R^1$ is an alkyl, alkenyl or hydroxyalkyl moiety ranging from 10 to 24 carbon atoms in chain length; and $R^2$ and $R^3$ are each alkyl moieties separately selected from alkyl or hydroxyalkyl groups containing 1 to 3 carbon atoms.

Examples of useful phosphine oxides include dimethyldecylphosphine oxide, dimethyltetradecylphosphine oxide, methylethyltetradecylphosphine oxide, dimethylhexadecylphosphine oxide, diethyl-2-hydroxyoctyidecylphosphine oxide, bis(2-hydroxyethyl)dodecylphosphine oxide, and bis(hydroxymethyl)tetradecylphosphine oxide.

Semi-polar nonionic surfactants useful herein also include the water soluble sulfoxide compounds which have the structure:

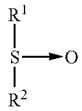

(VI)

wherein the arrow is a conventional representation of a semi-polar bond; and, $R^1$ is an alkyl or hydroxyalkyl moiety of 8 to 28 carbon atoms, from 0 to 5 ether linkages and from 0 to 2 hydroxyl substituents; and $R^2$ is an alkyl moiety consisting of alkyl and hydroxyalkyl groups having 1 to 3 carbon atoms.

Useful examples of these sulfoxides include dodecyl methyl sulfoxide; 3-hydroxy tridecyl methyl sulfoxide; 3-methoxy tridecyl methyl sulfoxide; and 3-hydroxy-4-dodecoxybutyl methyl sulfoxide.

Moreover, other common nonionic surfactants may also be used. Those nonionic surfactants are generally characterized by the presence of an organic hydrophobic group and an organic hydrophilic group and are typically produced by the condensation of an organic aliphatic, alkyl aromatic or polyoxyalkylene hydrophobic compound with a hydrophilic oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties. Useful nonionic surfactants in the present invention include:

1. Block polyoxypropylene-polyoxyethylene polymeric compounds based upon propylene glycol, ethylene glycol, glycerol, trimethylolpropane, and ethylenediamine as the initiator reactive hydrogen compound. Examples of polymeric compounds made from a sequential propoxylation and ethoxylation of initiator are commercially available under the trade names Pluronic® and Tetronic® manufactured by BASF Corp.

Pluronic® compounds are difunctional (two reactive hydrogens) compounds formed by condensing ethylene oxide with a hydrophobic base formed by the addition of propylene oxide to the two hydroxyl groups of propylene glycol. This hydrophobic portion of the molecule weighs from 1,000 to 4,000. Ethylene oxide is then added to sandwich this hydrophobe between hydrophilic groups, controlled by length to constitute from about 10% by weight to about 80% by weight of the final molecule.

Tetronic® compounds are tetra-functional block copolymers derived from the sequential addition of propylene oxide and ethylene oxide to ethylenediamine. The molecular weight of the propylene oxide hydrotype ranges from 500 to 7,000; and, the hydrophile, ethylene oxide, is added to constitute from 10% by weight to 80% by weight of the molecule.

2. Condensation products of one mole of alkyl phenol wherein the alkyl chain, of straight chain or branched chain configuration, or of single or dual alkyl constituent, contains from 8 to 18 carbon atoms with from 3 to 50 moles of ethylene oxide. The alkyl group can, for example, be represented by diisobutylene, di-amyl, polymerized propylene, iso-octyl, nonyl, and di-nonyl. These surfactants can be polyethylene, polypropylene, and polybutylene oxide condensates of alkyl phenols. Examples of commercial compounds of this chemistry are available on the market under the trade names Igepal® manufactured by Rhone-Poulenc and Triton® manufactured by Union Carbide.

3. Condensation products of one mole of a saturated or unsaturated, straight or branched chain, generally aliphatic alcohol having from 6 to 24 carbon atoms with from 3 to 50, preferably from 3 to 18 moles of ethylene oxide. The alcohol moiety can consist of mixtures of alcohols in the above delineated carbon range or it can consist of an alcohol having a specific number of carbon atoms within this range. Preferred alcohols for use in the composition of the present invention have alkyl moieties like decyl, dodecyl, tridecyl, tetradecyl, pentadecyl or hexadecyl or mixtures thereof. Examples of like commercial surfactant are available under the trade names Neodol® manufactured by Shell Chemical Co. Alfonic® manufactured by Vista Chemical Co., Tegotens® manufactured by Goldschmidt, Genapol® manufactured by Clariant and Lutensol® manufactured by BASF.

The ethoxylated $C_6$-$C_{24}$ fatty alcohols may additionally be propoxylated. Particularly those are suitable surfactants for use in the present compositions that are water soluble. Suitable ethoxylated and propoxylated fatty alcohols include the $C_6$-$C_{24}$, preferably the $C_{10}$-$C_{18}$ ethoxylated and propoxylated fatty alcohols with a degree of ethoxylation of from 3 to 50, preferably of from 3 to 18, and with a degree of propoxylation of from 3 to 50, preferably of from 3 to 18 and more preferred of from 4 to 10. Such surfactants are commercially available, for example under the trade names Genapol® manufactured by Clariant.

4. Condensation products of one mole of saturated or unsaturated, straight or branched chain carboxylic acid having from 8 to 18 carbon atoms with from 6 to 50 moles of ethylene oxide. The acid moiety can consist of mixtures of acids in the above defined carbon atoms range or it can consist of an acid having a specific number of carbon atoms within the range. Examples of commercial compounds of this chemistry are available on the market under the trade names Nopalcol® manufactured by Henkel Corporation and Lipopeg® manufactured by Lipo Chemicals, Inc.

In addition to ethoxylated carboxylic acids, commonly called polyethylene glycol esters, other alkanoic acid esters formed by reaction with glycerides, glycerin, and polyhydric (saccharide or sorbitan/sorbitol) alcohols have application in this invention. All of these ester moieties have one or more reactive hydrogen sites on their molecule which can undergo further acylation or ethylene oxide (alkoxide) addition to control the hydrophilicity of these substances. Care must be exercised when adding these fatty ester or acylated carbohydrates to compositions of the present invention containing amylase and/or lipase enzymes because of potential incompatibility.

Examples of nonionic low foaming surfactants include:

5. Compounds from (1) which are modified, essentially reversed, by adding ethylene oxide to ethylene glycol to provide a hydrophile of designated molecular weight; and, then adding propylene oxide to obtain hydrophobic blocks on the outside (ends) of the molecule. The hydrophobic portion of the molecule weighs from 1,000 to 3,100 with the central hydrophile including 10% by weight to 80% by weight of the final molecule. These reverse Pluronics® are manufactured by BASF Corporation under the trade name Pluronic® R surfactants.

Likewise, the Tetronic® R surfactants are produced by BASF Corporation by the sequential addition of ethylene oxide and propylene oxide to ethylenediamine. The hydrophobic portion of the molecule weighs from 2,100 to 6,700 with the central hydrophile including 10% by weight to 80% by weight of the final molecule.

6. Compounds from groups (1), (2), (3) and (4) which are modified by "capping" or "end blocking" the terminal hydroxy group or groups (of multifunctional moieties) to reduce foaming by reaction with a small hydrophobic molecule such as propylene oxide, butylene oxide, benzyl chloride; and, short chain fatty acids, alcohols or alkyl halides containing from 1 to 5 carbon atoms; and mixtures thereof. Such surfactants are commercially available, for example under the trade names Tegotens® manufactured by Goldschmidt and Dehypon® manufactured by Cognis. Also included are reactants such as thionyl chloride which convert terminal hydroxy groups to a chloride group. Such modifications to the terminal hydroxy group may lead to all-block, block-heteric, heteric-block or all-heteric nonionics.

Additional examples of effective low foaming nonionics include:

7. The alkylphenoxypolyethoxyalkanols of U.S. Pat. No. 2,903,486 issued Sep. 8, 1959 to Brown et al. and represented by the formula

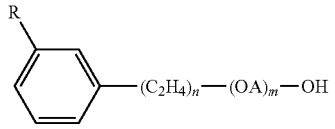

(VII)

in which R is an alkyl group of 8 to 9 carbon atoms, A is an alkylene chain of 3 to 4 carbon atoms, n is an integer of 7 to 16, and m is an integer of 1 to 10.

The polyalkylene glycol condensates of U.S. Pat. No. 3,048,548 issued Aug. 7, 1962 to Martin et al. having alternating hydrophilic oxyethylene chains and hydrophobic oxypropylene chains where the weight of the terminal hydrophobic chains, the weight of the middle hydrophobic unit and the weight of the linking hydrophilic units each represent about one-third of the condensate.

The defoaming nonionic surfactants disclosed in U.S. Pat. No. 3,382,178 issued May 7, 1968 to Lissant et al. having the general formula $Z[(OR)_nOH]_z$ wherein Z is alkoxylatable material, R is a radical derived from an alkylene oxide which can be ethylene and propylene and n is an integer from, for example, 10 to 2,000 or more and z is an integer determined by the number of reactive oxyalkylatable groups.

The conjugated polyoxyalkylene compounds described in U.S. Pat. No. 2,677,700, issued May 4, 1954 to Jackson et al. corresponding to the formula $Y(C_3H_6O)_n(C_2H_4O)_mH$ wherein Y is the residue of an organic compound having from 1 to 6 carbon atoms and one reactive hydrogen atom, n has an average value of at least 6.4, as determined by hydroxyl number and m has a value such that the oxyethylene portion constitutes 10% to 90% by weight of the molecule.

The conjugated polyoxyalkylene compounds described in U.S. Pat. No. 2,674,619, issued Apr. 6, 1954 to Lundsted et al. having the formula $Y[(C_3H_6O)_n(C_2H_4O)_mH]_x$ wherein Y is the residue of an organic compound having from 2 to 6 carbon atoms and containing x reactive hydrogen atoms in which x has a value of at least 2, n has a value such that the molecular weight of the polyoxypropylene hydrophobic base is at least 900 and m has value such that the oxyethylene content of the molecule is from 10% to 90% by weight. Compounds falling within the scope of the definition for Y include, for example, propylene glycol, glycerol, pentaerythritol, trimethylolpropane, ethylenediamine and the like. The oxypropylene chains optionally, but advantageously, contain small amounts of ethylene oxide and the oxyethylene chains also optionally, but advantageously, contain small amounts of propylene oxide.

Additional conjugated polyoxyalkylene surface-active agents which are advantageously used in the compositions of this invention correspond to the formula: $P[(C_3H_6O)_n(C_2H_4O)_mH]_x$ wherein P is the residue of an organic compound having from 8 to 18 carbon atoms and containing x reactive hydrogen atoms in which x has a value of 1 or 2, n has a value such that the molecular weight of the polyoxyethylene portion is at least 44 and m has a value such that the oxypropylene content of the molecule is from 10% to 90% by weight. In either case the oxypropylene chains may contain optionally, but advantageously, small amounts of ethylene oxide and the oxyethylene chains may contain also optionally, but advantageously, small amounts of propylene oxide.

8. Polyhydroxy fatty acid amide surfactants suitable for use in the pre-sent compositions include those having the structural formula $R^2CONR^1Z$ in which: $R^1$ is H, $C_1$-$C_4$ hydrocarbyl, 2-hydroxy ethyl, 2-hydroxy propyl, ethoxy, propoxy group, or a mixture thereof; $R^2$ is a $C_5$-$C_{31}$ hydrocarbyl, which can be straight-chain; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z can be derived from a reducing sugar in a reductive amination reaction; such as a glycityl moiety.

9. Suitable nonionic alkylpolysaccharide surfactants, particularly for use in the present compositions include those disclosed in U.S. Pat. No. 4,565,647, Llenado, issued Jan. 21, 1986. These surfactants include a hydrophobic group containing from 6 to 30, preferably from 8 to 12 carbon atoms and a polysaccharide, e.g., a polyglycoside, hydrophilic group containing from 1.3 to 10 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

10. Fatty acid amide surfactants suitable for use in the present compositions include those having the formula: $R^6CON(R^7)_2$ in which $R^6$ is an alkyl group containing from 7 to 21 carbon atoms and each $R^7$ is independently hydrogen, $C_1$-$C_4$ alkyl, $C_1$-$C_4$ hydroxyalkyl, or $—(C_2H_4O)_xH$, where x is in the range of from 1 to 3.

11. A useful class of non-ionic surfactants includes the class defined as alkoxylated amines or, most particularly, alcohol alkoxylated/aminated/alkoxylated surfactants. These non-ionic surfactants may be at least in part represented by the general formulae:

$$R^{20}—(PO)_sN\text{-}(EO)_tH,$$

$$R^{20}—(PO)_sN\text{-}(EO)_tH(EO)_tH, \text{ and}$$

$$R^{20}—N(EO)_tH;$$

in which $R^{20}$ is an alkyl, alkenyl or other aliphatic group, or an alkyl-aryl group of from 8 to 20, preferably 12 to 14 carbon atoms, EO is oxyethylene, PO is oxypropylene, s is 1 to 20, preferably 2-5, t is 1-10, preferably 2-5, and u is 1-10, preferably 2-5. Other variations on the scope of these compounds may be represented by the alternative formula:

$$R^{20}—(PO)_v—N[(EO)_wH][(EO)_zH]$$

in which $R^{20}$ is as defined above, v is 1 to 20 (e.g., 1, 2, 3, or 4 (preferably 2)), and w and z are independently 1-10, preferably 2-5.

These compounds are represented commercially by a line of products sold by Huntsman Chemicals as nonionic surfactants. A preferred chemical of this class includes Surfonic™ PEA 25 Amine Alkoxylate.

The treatise *Nonionic Surfactants*, edited by Schick, M. J., Vol. 1 of the Surfactant Science Series, Marcel Dekker, Inc., New York, 1983 is an excellent reference on the wide variety of nonionic compounds generally employed in the practice of the present invention. A typical listing of nonionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Also useful in the present invention are surface active substances which are categorized as anionics because the charge on the hydrophobe is negative; or surfactants in which the hydrophobic section of the molecule carries no charge unless the pH is elevated to neutrality or above (e.g. carboxylic acids). Carboxylate, sulfonate, sulfate and phosphate are the polar (hydrophilic) solubilizing groups found in anionic surfactants. Of the cations (counter ions) associated with these polar groups, sodium, lithium and potassium impart water solubility; ammonium and substituted ammonium ions provide both water and oil solubility; and, calcium, barium, and magnesium promote oil solubility.

As those skilled in the art understand, anionics are excellent detersive surfactants and are therefore favored additions to heavy duty detergent compositions. Generally, however, anionics have high foam profiles. Anionics are very useful additives to preferred compositions of the present invention. Further, anionic surface active compounds are useful to impart special chemical or physical properties other than detergency within the composition. Anionics can be employed as gelling agents or as part of a gelling or thickening system. Anionics are excellent solubilizers and can be used for hydrotropic effect and cloud point control.

The majority of large volume commercial anionic surfactants can be subdivided into five major chemical classes and additional sub-groups known to those of skill in the art and described in "Surfactant Encyclopedia," *Cosmetics & Toiletries*, Vol. 104 (2) 71-86 (1989). The first class includes acylamino acids (and salts), such as acylglutamates, acyl peptides, sarcosinates (e.g. N-acyl sarcosinates), taurates (e.g. N-acyl taurates and fatty acid amides of methyl tauride), and the like. The second class includes carboxylic acids (and salts), such as alkanoic acids (and alkanoates), ester carboxylic acids (e.g. alkyl succinates), ether carboxylic acids, and the like. The third class includes phosphoric acid esters and their salts. The fourth class includes sulfonic acids (and salts), such as isethionates (e.g. acyl isethionates), alkylaryl sulfonates, alkyl sulfonates, sulfosuccinates (e.g. monoesters and diesters of sulfosuccinate), and the like. The fifth class includes sulfuric acid esters (and salts), such as alkyl ether sulfates, alkyl sulfates, and the like.

Appropriate anionic surfactants represent sulfosuccinates represented by the general formula:

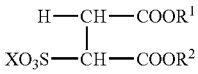

(VIII)

with $R^1$=$C_{8-12}$, $R^2$=H, $C_{8-12}$, and X=Na, K, $NH_4^+$. The alkyl residue of the ester moiety may be linear or branched, preferably it is linear. It is particularly preferred to use sulfosuccinate compounds which are water soluble. A suitable example represents sodiumdiisooctyl sulfosuccinate.

Anionic sulfate surfactants suitable for use in the present compositions include the linear and branched primary and secondary alkyl sulfates, alkyl ethoxysulfates, fatty oleyl glycerol sulfates, alkyl phenol ethylene oxide ether sulfates, the $C_5$-$C_{17}$ acyl-N—($C_1$-$C_4$ alkyl) and —N—($C_1$-$C_2$ hydroxyalkyl) glucamine sulfates, and sulfates of alkylpolysaccharides such as the sulfates of alkylpolyglucoside (the nonionic nonsulfated compounds being described herein).

Examples of suitable synthetic, water soluble anionic detergent compounds include the ammonium and substituted ammonium (such as mono-, di- and triethanolamine) and alkali metal (such as sodium, lithium and potassium) salts of the alkyl mononuclear aromatic sulfonates such as the alkyl benzene sulfonates containing from 5 to 18 carbon atoms in the alkyl group in a straight or branched chain, e.g., the salts of alkyl benzene sulfonates or of alkyl toluene, xylene, cumene and phenol sulfonates; alkyl naphthalene sulfonates, diamyl naphthalene sulfonates, and dinonyl naphthalene sulfonates and alkoxylated derivatives.

Anionic carboxylate surfactants suitable for use in the present compositions include the alkyl ethoxy carboxylates, the alkyl polyethoxy polycarboxylate surfactants and the soaps (e.g. alkyl carboxyls). Secondary soap surfactants (e.g. alkyl carboxyl surfactants) useful in the present compositions include those which contain a carboxyl unit connected to a secondary carbon. The secondary carbon can be in a ring structure, e.g. as in p-octyl benzoic acid, or as in alkyl-substituted cyclohexyl carboxylates. The secondary soap surfactants typically contain no ether linkages, no ester linkages and no hydroxyl groups. Further, they typically lack nitrogen atoms in the head-group (amphiphilic portion). Suitable secondary soap surfactants typically contain 11-13 total carbon atoms, although more carbons atoms (e.g., up to 16) can be present.

Other anionic detergents suitable for use in the present compositions include olefin sulfonates, such as long chain alkene sulfonates, long chain hydroxyalkane sulfonates or mixtures of alkenesulfonates and hydroxyalkane-sulfonates. Also included are the alkyl sulfates, alkyl poly(ethyleneoxy) ether sulfates and aromatic poly(ethyleneoxy) sulfates such as the sulfates or condensation products of ethylene oxide and nonyl phenol (usually having 1 to 6 oxyethylene groups per molecule). Resin acids and hydrogenated resin acids are also suitable, such as rosin, hydrogenated rosin, and resin acids and hydrogenated resin acids present in or derived from tallow oil.

In particular in case an additional disinfective effect is desired it may be advantageous to use one or more cationic surfactants. Suitable cationic surfactants represent quaternary ammonium compounds. They can be exemplified by short-chain, water-soluble quaternary ammonium compounds like trihydroxyethyl methyl ammonium methosulfate, alkyl dimethyl ammonium adipates or alkyl trimethyl ammonium chlorides, dialkyl dimethyl ammonium chlorides and trialkyl methyl ammonium chlorides, for example cetyl trimethyl ammonium chloride, stearyl trimethyl ammonium chloride, distearyl dimethyl ammonium chloride, lauryl trimethyl ammonium chloride, lauryl dimethyl benzyl ammonium chloride and tricetyl methyl ammonium chloride. Moreover, benzalkonium salts, benzethonium salts and biguanide compounds may be used in the present composition.

Further suitable cationic surfactants correspond to formulae (IX) and (X):

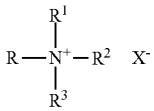

(IX)

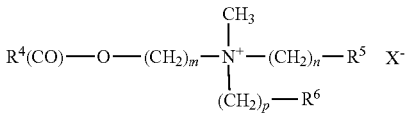

(X)

where R and $R^1$ represent an acyclic alkyl group having 12 to 24 carbon atoms, $R^2$ is a saturated $C_{1-4}$ alkyl or hydroxyalkyl group, $R^3$ is either the same as R, $R^1$ or $R^2$ or represents an aromatic radical. $X^-$ is either a halide, a methosulfate, a methophosphate or a phosphate ion or a mixture thereof. Examples of cationic compounds corresponding to formula (IX) represent didecyl dimethyl ammonium chloride, ditallow dimethyl ammonium chloride or dihexadecyl ammonium chloride.

Compounds corresponding to formula (X) are so-called esterquats. Esterquats are distinguished by excellent biodegradability. In that formula $R^4$ is an aliphatic acyl group containing 12 to 22 carbon atoms and 0, 1, 2 or 3 double bonds, $R^5$ is H, OH or O(CO)$R^6$, $R^7$ independently of $R^6$ stands for H, OH or O(CO)$R^8$, $R^7$ and $R^8$ independently of one another representing an aliphatic acyl group containing 12 to 22 carbon atoms and 0, 1, 2 or 3 double bonds. m, n and p independently of one another can have a value of 1, 2 or 3. $X^-$ can be a halide, a methosulfate, a methophosphate or a phosphate ion or a mixture thereof. Preferred compounds contain the group O(CO)$R^7$ for $R^4$ and $C_{16-18}$ alkyl groups for $R^4$ and $R^7$. Particularly preferred compounds are those in which $R^1$ is also OH. Examples of compounds corresponding to formula (X) are methyl-N-(2-hydroxyethyl)-N,N-di(tallowacyloxyethyl)-ammonium methosulfate, bis-(palmitoyl)-ethyl hydroxyethyl methyl ammonium methosulfate or methyl-N,N-bis-(acyloxyethyl)-N-(2-hydroxyethyl)-ammonium methosulfate. Commercially available examples for quaternized compounds corresponding to formula (X) represent methyl hydroxyalkyl dialkoyloxyalkyl ammonium methosulfates marketed by Stepan under the name of Stepantex® or the Cognis products known under the name of Dehyquart® as well as the Goldschmidt-Witco products known under the name of Rewoquat®. Other preferred compounds are the diesterquats corresponding to formula (XI) which are obtainable under the name of Rewoquat® W 222 LM or CR 3099.

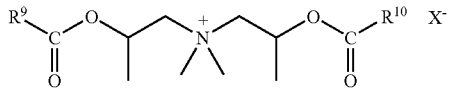

(XI)

In formula (XI), $R^9$ and $R^{10}$ independently of one another each represent an aliphatic acyl group containing 12 to 22 carbon atoms and 0, 1, 2 or 3 double bonds.

Besides the quaternary compounds described above, other known compounds may also be used, including for example quaternary imidazolinium compounds corresponding to formula (XII):

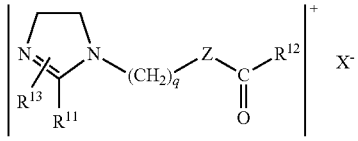

(XII)

in which $R^{13}$ represents H or a saturated alkyl group containing 1 to 4 carbon atoms, $R^{11}$ and $R^{12}$ independently of one another represent an aliphatic, saturated or unsaturated alkyl group containing 12 to 18 carbon atoms, $R^{11}$ alternatively may also represent $O(CO)R^{14}$, $R^{14}$ being an aliphatic, saturated or unsaturated alkyl group containing 12 to 18 carbon atoms, and Z is an NH group or oxygen and $X^-$ is an anion as specified above. q may be an integer of 1 to 4.

Other suitable quaternary compounds correspond to formula (XIII):

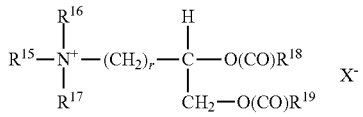

(XIII)

where $R^{15}$, $R^{16}$ and $R^{17}$ independently of one another represent a $C_{1-4}$ alkyl, alkenyl or hydroxyalkyl group, $R^{18}$ and $R^{19}$ independently of one another represent a $C_{8-28}$ alkyl group and r is a number of 1 to 5.

Other suitable compounds correspond to the following formula:

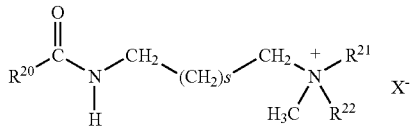

(XIV)

and may be alkylamidoamines in their non-quaternized form or, as illustrated, in their quaternized form. In formula (XIV), $R^{20}$ may be an aliphatic acyl group containing 12 to 22 carbon atoms and 0, 1, 2 or 3 double bonds. s may assume a value of 0 to 5. $R^{21}$ and $R^{22}$ independently of one another represent H, $C_{1-4}$ alkyl or hydroxyalkyl. Preferred compounds are fatty acid amidoamines, such as stearylamidopropyl dimethylamine obtainable under the name of Tego Amid® S 18 or the 3-tallowamidopropyl trimethylammonium methosulfate obtainable as Stepantex® X 9124, which are distinguished by ready biodegradability.

Examples of amphoteric or zwitterionic surfactants, respectively, which are suitable in the composition according to the present invention, include alkyl carboxybetaines, alkyl sulfobetaines, alkyl hydroxysulfobetaines, alkyl amidobetaines, imidazolinium betaines, alkyl diaminoethyl glycines, dialkyl diaminoethyl glycines or a mixture thereof.

Anyway, in case a mixture of surfactants of one or more types is used the surfactants should be chosen such that they rapidly wet the surface and show an acceptable residue performance i.e. they do not tend to leave reams, stripes or spots on the surface after the surface has dried. It is also preferred that the one or more surfactants are chosen such that a more or less clear solution results.

In a preferred embodiment, in case the pH value of the composition is equal to or above 7 it is preferred to use a mixture of anionic and nonionic surfactants.

In an especially preferred embodiment such a combination of surfactants comprises either at least two nonionics or one or two nonionics in combination with at least one anionic, preferably with two or more anionics. A particular advantageous composition includes at least one amine oxide, and two to four, preferably two anionics, especially including at least one $C_{10}$-$C_{16}$ alkylsulfonate and at least one sodiumdialkyl sulfosuccinate like sodium diisooctyl sulfosuccinate. Such compositions are commercially available like the one designated as Rewopol® WP35, manufactured by Goldschmidt/Degussa.

The best results are achieved if the surfactants are comprised in the composition in a total amount of from 0 to 5 wt. %, preferably 0.01 to 3 wt. %, more preferred of from 0.1 to 1.5 wt. %, still more preferred of from 0.3 to 0.7 wt. % and most preferred of from 0.5 to 0.6 wt. % based on the total end use composition. Those amounts refer to the amounts of the active substance. In case commercially available products are employed which are diluted for example with water this has to be taken into account. Moreover the amounts refer to the end use composition. This especially should be born in mind in case a concentrate is prepared and not the use solution directly.

As to the concentrate the surfactants preferably are contained therein in a total amount of from 0.05 to 15 wt. %, preferably of from 0.5 to 10 wt. % and more preferred of from 1.2 to 6 wt. %.

As already mentioned before, the composition of the present invention may be prepared in the form of a concentrate or in the form of an end use composition. The concentrate should comprise an amount of water corresponding to 10 to 30 wt. %, preferably 15 to 25 wt. % and more preferred 18 to 22 wt. % of the water as contained in the total end use composition whereas the water content in the end use composition preferably ranges from 70 to 99.97 wt. %, preferably of from 80 to 99 wt. % and more preferred of from 85 to 98 wt. % based on the total composition.

The water content in the concentrate as mentioned above preferably corresponds to 10 to 90 wt. %, more preferred to 20 to 70 wt. % and most preferred to 35 to 55 wt. % based on the concentrate composition.

The composition according to the present invention may additionally contain one or more further compounds which are usually used in compositions for cleaning or treating a surface, in particular a hard surface. Such additives can be exemplified by organic solvents, agents for adjusting the pH value, buffering agents, complexing agents, perfumes, coloring agents, builders, disinfecting agents, enzymes, bleaching agents, finishing agents and preservatives.

The compositions according to the present invention may be adjusted such that they have a pH value of from 1 to 12. Alkaline compositions according to the pre-sent invention preferably have a pH value of from 8 to 10 whereas acidic compositions preferably have a pH value of from 2 to 5. Depending on whether the composition is alkaline or acidic the additives and to some extent even the main components in the components slightly differ. For example as mentioned above, in an acidic composition it is particularly preferred to use one or more nonionics whereas in an alkaline composition it is most preferred to use a mixture of one or more anionics and one or more nonionics.

Moreover, as bases typically are added in alkaline compositions to achieve a corresponding high pH value this is not necessary and also not desired with acidic compositions.

Moreover, the kind of the additives used and their amounts should be chosen such that a clear solution results.

The one or more organic solvents are intended to provide a composition with good wetting properties and to facilitate the evaporation of the composition on the surface to be cleaned or treated to achieve a rapid drying. Suitable organic solvents for use in the present composition represent alkylene glycol (mono and/or di) alkyl ether like ethylene glycol monomethyl ether, ethylene glycol dimethyl ether, ethylene glycol monoethyl ether, ethylene glycol monobutyl ether, propylene glycol monomethyl ether, propylene glycol monoethyl ether, propylene glycol monobutyl ether, propylene glycol monophenyl ether, diethylene glycol monomethyl ether, diethylene glycol monoethyl ether, diethylene glycol monobutyl ether, dipropylene glycol monomethyl ether, dipropylene glycolmonoethyl ether, dipropylene glycol monobutal ether, triethylene glycol monobutyl ether, tripropylene glycol dimethyl ether, and mixtures thereof. Propylene glycol monobutyl ether is most preferred.

Moreover aliphatic monohydric, dihydric or trihydric alcohols having 1 to 4 carbon atoms may function as organic solvent in the present composition as well. Suitable alcohols represent methanol, ethanol, n-propanol, iso-propanol, n-butanol, isobutanol, sec-butanol, tert. butanol, glycerol, ethylene glycol, propylene glycol or mixtures thereof.

Preferably the one or more organic solvents are contained in the composition in a total amount of from 0 to 10 wt. % more preferred of from 1 to 8 wt. %, most preferred of from 2 to 5 wt. % based on the whole end use composition. Those amounts refer to the amount of the active substance. In case commercially available products are employed which are diluted for example with water this has to be taken into account. Moreover the amounts refer to the end use composition. This especially should be born in mind in case a concentrate is prepared and not the use solution directly.

As to the concentrate the one or more organic solvents preferably are contained therein in a total amount of from 0 to 25 wt. %, preferably of from 1 to 20 wt. % and more preferred of from 5 to 15 wt. %.

For adjusting the desired pH value depending on the pH of the mixture comprising the three main components, organic or inorganic acids or bases may be used. They may also include buffering substances. Suitable bases for use in the present compositions represent ammonia, preferably in form of its aqueous solution, alkylamines having 1 to 8 carbon atoms in the alkyl moiety like monoethanolamine and diethanolamine. Further alkaline compounds for use in the present composition are exemplified by alkali hydroxides, like sodium hydroxide or potassium hydroxide.

Preferably the one or more alkaline substances are contained substantially in the alkaline composition in a total amount of from 0 to 5 wt. % more preferred of from 0.01 to 3 wt. %, most preferred of from 0.05 to 1.5 wt. % based on the whole end use composition. Those amounts refer to the amount of the active substance. In case commercially available products are employed which are diluted for example with water this has to be taken into account. It is preferred that no alkaline compounds are used to form the acidic compositions.

As to the concentrate the one or more alkaline substances preferably are contained therein in a total amount of from 0 to 10 wt. %, preferably of from 0.05 to 5 wt. % and more preferred of from 0.1 to 2 wt. %.

Examples of appropriate acids for use in the present compositions include organic acids like acetic acid, citric acid, glycolic acid, lactic acid, succinic acid, adipic acid, malic acid, tartaric acid and gluconic acid and also amidosulfuric acid. Besides, mineral acids like hydrochloric acid, sulfuric acid and nitric acid can be employed. Mixtures of any of those acids may also be used. The acids may be used mainly for acidic compositions but may also be included in the alkaline compositions to adjust a specific pH value.

Whereas alkaline compounds preferably are only used to form alkaline compositions acids may be used for the preparation of acidic as well as alkaline compositions. In alkaline compositions acidic compounds typically function as regulators of the pH value. Consequently, concerning the amount of acidic components it should be distinguished between acidic and alkaline compositions. Preferably the one or more acids are contained in an alkaline composition in a total amount of from 0 to 5 wt. % more preferred of from 0.01 to 3 wt. %, most preferred of from 0.02 to 1.5 wt. % based on the whole end use composition. As to acidic compositions, the one or more acids should be contained therein in a total amount of from 0 to 25 wt. % more preferred of from 0.1 to 15 wt. %, most preferred of from 0.5 to 5 wt. % based on the whole end use composition. Those amounts refer to the amount of the active substance. In case commercially available products are employed which are diluted for example with water this has to be taken into account.

As to the alkaline concentrates the one or more acids preferably are contained therein in a total amount of from 0 to 10 wt. %, preferably of from 0.05 to 5 wt. % and more preferred of from 0.1 to 2 wt. %. Analogous, the acidic concentrates preferably contain the one or more acids in a total amount of from 0 to 50 wt. %, preferably of from 0.5 to 25 wt. % and more preferred of from 2 to 10 wt. %.

Furthermore the composition according to the present invention may comprise complexing agents. Suitable compounds for use in the present composition include ethylenediaamine tetraacetic acid, nitrilotriacetic acid, phosphates, polyhydroxy carboxylic acids, citrates, triethanol amine, sodiummethylglycin diacetate, which is especially preferred, and mixtures thereof.

Preferably the one or more complexing agents are contained in the composition in a total amount of from 0 to 5 wt. % more preferred of from 0.01 to 3 wt. %, most preferred of from 0.02 to 1.5 wt. % based on the whole end use composition. Those amounts refer to the amount of the active substance. In case commercially available products are employed which are diluted for example with water this has to be taken into account.

As to the concentrate the one or more complexing agents preferably are contained therein in a total amount of from 0.05 to 15 wt. %, preferably of from 0.5 to 10 wt. % and more preferred of from 1.2 to 6 wt. %.

Although the sequence for admixing the single components is not particularly limited, in order to obtain a stable and clear solution the alkaline composition is pre-pared by mixing a minimum amount of water which corresponds to 10 to 30 wt. %, preferably 15 to 25 wt. % and more preferred 18 to 22 wt. % of the water as contained in the total end use composition with the combined surfactants and organic solvents, if present. Afterwards the amphoteric, organic polynitrogen-compounds are added followed by the addition of the nanoparticles. The further additives like bases, perfumes, coloring agents, complexing agents are incorporated. The desired amount of acid may be added here or at the end, but preferably not at the end. After having mixed the above mentioned compounds a concentrate is obtained. The concentrate may be further diluted with the remaining amount of water to obtain the end use composition or it may be sold as such and the remaining amount may be added by the user.

When preparing an acidic composition it is preferred to first dose the total amount of water supposed to be contained in the concentrate or the end use solution, depending on the desired composition. Afterwards the other components are added wherein the surfactants, if contained, preferably are added before admixing any perfume. When having prepared a concentrate it may directly or later on be diluted to obtain the end use composition.

Surprisingly, it has been found out that the composition as specified above shows an improved performance like improved drying performance, a reduced re-soiling and facilitated re-cleaning properties with an at least not deteriorated overall cleaning performance in comparison with the compounds of the state of the art. It was particularly surprising that the combination of the main components, amphoteric, organic polynitrogen-compounds having at least 3 nitrogen atoms contained in the molecule in the form of an amine and/or amide, surfactants and inorganic nanoparticles, results in stable compositions. As nanoparticles specified herein typically exhibit a reduced stability under acidic conditions and the organic polynitrogen compounds show an reduced stability or at least a reduced performance in alkaline solution, it could not have been expected that said combination of components would result in a stable composition under alkaline as well as under acidic conditions and as well shows improved properties.

A further object of the present invention relates to a method for treating and/or cleaning a surface comprising a) applying the composition as specified above onto said surface b) rinsing, drying, blowing, sucking off, heating and/or wiping the surface.

Preferably, the compositions are used for cleaning surfaces and in particular hard surface, more preferred polar surfaces. Suitable surfaces to be cleaned using the composition according to the present invention include glass, like windows, but also mirrors, lenses, for example of optical devices, spectacles or glasses used for drinking. The composition may also be used for cleaning other surfaces which are more or less frequently rinsed with contaminated or clean water like showers, bathtubs and floors, walls or windows in a bathroom, in a kitchen (either private or in a canteen kitchen), in public baths or saunas, in gymnasiums or other sport facilities. Further surfaces which may be cleaned with the present composition represent dishware in a dishwasher. However, in the dishwasher the compositions is preferably used as a rinse aid. It is also advantageous to use the present composition on surfaces of automobiles like windows but also lacquered surfaces of the car body. Metal surfaces and other lacquered surface may also be cleaned with the present composition. Amazingly the present composition is also appropriate for textile surfaces which are hydrophilized by treatment with the present composition.

The composition of the present invention may be applied by any means known by the skilled person, including spraying, pouring, wiping, dipping, misting, rolling, brushing and foaming. Although it is also possible to apply the composition in the form of its concentrate the best performance is obtained when applying the diluted concentrate as end use composition.

After having applied the composition the surface may be rinsed, although this is not preferred. The surface should rather be allowed to air-dry or it should at least partly be dried with a cloth or other kinds of textiles or cellulose fabrics.

The composition according to the present invention is particularly used to reduce the resoiling of the surface, to improve the soil release properties and/or to generally hydrophilize the surface.

To avoid a permanent change of the surface to be cleaned or treated the composition according to the present invention is preferably not permanent. This may be achieved by using watersoluble or waterdispersible compounds as amphoteric organic polynitrogen compounds, like the ones specified above. Although the polynitrogen compounds may not be removed from the surface with the next rinsing for example with water, at least after several rinsing courses the components remaining on the surface, mainly the amphoteric organic polynitrogen compounds and the nanoparticles, are removed. However, it can be desired to obtain an artificial permanent effect by repeating the application of the composition according to the present invention regularly. Thereby, an even improved performance can be observed. However, even after repeated treatments the remains on the surface may easily be removed if desired.

The present invention will be further elucidated in the following examples. Unless otherwise indicated the amounts represent wt. %.

EXAMPLES

Table 1 shows some alkaline compositions which may be used in the present invention (Ex.) and also two comparative compositions (CEx.).

TABLE 1

| | CEx. 1 | CEx. 2 | Ex. 1 | Ex. 2 | Ex. 3 | Ex. 4 | Ex. 5 |
|---|---|---|---|---|---|---|---|
| Water demineralized | 93.28 | 93.59 | 92.58 | 93.08 | 93.67 | 93.08 | 92.88 |
| Isopropanol | 3.0 | 3.0 | 3.0 | — | — | 3.0 | 3.0 |
| Ethanol, 96% | — | — | — | 3.0 | 3.0 | — | — |
| Propyl glycol monobutyl ether | 1.5 | 1.5 | 1.5 | 1.5 | 1.5 | 1.5 | 1.5 |
| Acetic acid, 60% | 0.34 | 0.03 | 0.04 | 0.04 | 0.03 | 0.04 | 0.04 |
| Citric acid × 1 $H_2O$ | — | — | 0.5 | — | — | — | — |
| Ammonia, 25% | 0.3 | 0.3 | 0.3 | 0.3 | 0.3 | 0.3 | 0.3 |
| Surfactant, 65%[1)] | 0.5 | 0.5 | 0.5 | 0.5 | 0.5 | 0.5 | 0.5 |
| Amphoteric polyamine[2)] | — | 0.5 | 0.5 | 0.5 | 0.5 | 0.5 | 0.5 |
| Colloidal silica sol nanoparticles[3)] | 0.5 | — | 0.5 | 0.5 | 0.5 | 0.5 | 0.7 |

TABLE 1-continued

| | CEx. 1 | CEx. 2 | Ex. 1 | Ex. 2 | Ex. 3 | Ex. 4 | Ex. 5 |
|---|---|---|---|---|---|---|---|
| Sodium methylglycin diacetate (40%, aqueous solution) | 0.5 | 0.5 | 0.5 | 0.5 | — | 0.5 | 0.5 |
| Perfume | 0.08 | 0.08 | 0.08 | 0.08 | 0.08 | 0.08 | 0.08 |
| pH value | 9.9 | 9.9 | 10 | 9.9 | 9.9 | 9.9 | 9.8 |

[1]mixture of anionic and nonionic surfactants containing decyldimethylaminoxide, sodium mono $C_{10}$-$C_{16}$ alkylester sulfonate, sodium diisooctyl sulfosuccinate in the form of an aqueous solution
[2]obtained from polyethylenimine and polyacrylic acid, 40% aqueous solution, supplied by BASF
[3]aqueous silica sol with a silica content of 30%, a BET surface area of 360 $m^2/g$, and an average particle size of 7-9 nm The compositions were prepared by pouring about 20% of the total amount of water into a container, adding a mixture of the surfactant and the solvent thereto, followed by subsequent addition of the Sokalan® HP70, the colloidal silica sol, a mixture of perfume and ammonia, the complexing agent (sodium methylglycin diacetate) and the remaining amount of water. While adding the single compounds the mixture is stirred. Stirring is continued until a clear solution is obtained. In order to optimize the comparability of the single compositions the pH value is adjusted to about 9-10 by adding the required amount of acetic acid.

Pre-testing of the single compositions showed that the best performance was obtained with examples 1 and 4. Therefore, the single performance tests were carried out using the composition of examples 1 and 4 in comparison with the compositions of comparative example 1 and 2.

Hydrophilizing Effect

Each of the compositions was sprayed onto the surface of one of identical plates made of glass in an amount of about 7-14 $g/m^2$. The surface was dried by wiping it with a cellulose fabric. Afterwards the test surfaces were sprayed with tap water and the wetted surface was allowed to dry. The spray behavior, the behavior of the flowing off the surface as well as the residues after drying were determined visually. The results are shown in table 2.

TABLE 2

| | Spraying behavior | Flow off behavior | Drying speed | Appearance after drying |
|---|---|---|---|---|
| CEx. 1 | Easy to spread, no reams | No hydrophilicity, lots of drops | 15 min | Lots of droplike residues |
| CEx. 2 | Easy to spread, no reams | Low hydrophilicity, film rapidly tears open | 15 min | Lots of droplike residues |
| Ex. 1 | Easy to spread, no reams | High hydrophilicity, uniform film | 10 min | In the upper part some reams, more reams in the lower part |
| Ex. 4 | Easy to spread, no reams | High hydrophilicity, uniform film | 10 min | In the upper part some reams, more reams in the lower part |

The results presented in table 2 show that a composition comprising an amphoteric polyamine as well as silica sol nanoparticles besides surfactants imparts a markedly increased hydrophilicity to a glass surface in comparison to a composition containing surfactants and either only the amphoteric polyamine or only the silica sol nanoparticles.

In the following, different surfaces were tested with regard to the tendency to become hydrophilized by the various compositions. The application of the single compositions onto the surface was carried out as described in the previous hydrophilicity test. The results are shown in table 3.

TABLE 3

| Hyrophilization on | CEx. 1 | CEx. 2 | Ex. 1 | Ex. 4 |
|---|---|---|---|---|
| Glass | No | Yes | Yes | Yes |
| Stainless steel | Yes | No | Yes | Yes |
| Marble* | Yes | Yes | Yes | Yes |
| Tiles, glazed** | Yes/No | Yes/No | Yes/No | Yes/No |
| Acrylic plastic | Yes | Yes | Yes | Yes |

*The untreated surface itself had such a high surface tension that there was no difference concerning the various compositions.
**Whereas the untreated surface leads to formation of large, long drops and stripes, the treated surface leads to a formation of lots of small drops. The performance of each of the various compositions did not significantly differ.

The results presented in table 3 show that with regard to marble, which as such has a hydrophilic surface without further treatment, tiles and acrylic plastic all compositions provide a similar hydrophilic effect to the treated surface. However, as to the glass surface the hydrophilicity of the inventive compositions is increased in comparison to the composition which is free of any amphoteric polynitrogen compound. In contrast thereto the hydrophilic effect of the inventive compositions is increased on metal in comparison with the composition which is free of any silica sol nanoparticles.

Cleaning Performance

To determine the cleaning performance of the compositions CEx. 1, CEx. 2 and Ex. 4 a gardner test was carried out. In this test glass stripes were soiled on a surface area of 3.9 cm×26 cm with a soiling called "window soiling, inside", commercially available from the Wäschereiforschung Krefeld (WFK), comprising skin fat, oil and pigments diluted with ethyl acetate.

In order to create a more stubborn soiling the glass stripes were pre-treated with hard water. Water having a water hardness of 42.2° dH was prepared by introducing 6 ml of a solution A into a volumetric 1000 ml-flask and adding 600 ml demineralized water thereto. Afterwards 8 ml of Solution B were added and the flask was filled up with water to a volume of 1000 ml.

Solution A was prepared by dissolving 19.84 g anhydrous $MgCl_2$ and 46.24 g anhydrous $CaCl_2$ in demineralized water and adding further demineralized water to result in 1000 ml of an aqueous solution. Solution B was prepared by dissolving 35.02 g anhydrous $NaHCO_3$ in demineralized water and adding further demineralized water to result in 1000 ml of an aqueous solution.

At first the glass stripes were pre-treated by rinsing with demineralized water, cleaning with isopropanol and drying with a cellulose fabric. Afterwards the water having a water hardness of 42.20 dH obtained above was sprayed in an amount of 60 $ml/m^2$ on the glass stripes and the thus treated glass stripes were dried.

11.07 g of the soiling were regularly distributed onto the thus pre-treated glass surface. The soiled test stripes were placed and fixed in a gardner testing device (supplied by Erichsen GmbH, model 494). The gardner test was carried out according to DIN ASTM-515. A sponge was soaked with 6 ml of the single compositions (one in a run) and placed in a fixed carrier of the testing device. The device moved the soaked sponge 4 times from one end of the soiled surface to the other and back with a speed of 0.4 m/s and a contact pressure of 8.2 N. After having finished the four cycles the test stripe is removed from the device and the remaining soiling is quantified by means of reflection measurement using a Chroma Meter CR 200, supplied by Minolta. The value obtained represents the percentage of the cleaning performance based on a stripe which was not soiled. Thus a completely cleaned stripe would obtain a value of 100. As further comparative "composition" tap water is used to soak the sponge. For each test stripe the reflection was measured on seven spots which were coincidentally chosen. The resulting values which are shown in table 4 represent the average of the seven measurements for each stripe treated with one of the compositions. The results are shown in table 5.

TABLE 5

| | Tap water | CEx. 1 | CEx. 2 | Ex. 4 |
|---|---|---|---|---|
| Maximum value | 67.60 | 71.66 | 71.00 | 71.45 |
| Minimum value | 54.58 | 69.38 | 70.37 | 70.34 |
| Δ (max-min) | 13.2 | 2.28 | 0.63 | 1.11 |
| Stand. dev. | 4.95 | 0.69 | 0.21 | 0.37 |
| Average | 60.20 | 70.76 | 70.63 | 70.92 |

The results in table 5 show that the compositions all show similar cleaning properties which are markedly better than the cleaning properties of pure water. However, neither the silica sol nanoparticles nor the amphiprotic polynitrogen compound seem to influence the cleaning properties.

Facilitated Cleaning of a Treated Surface

In order to determine the influence of the compositions on the easiness of a cleaning process subsequent to a pre-treatment with the compositions, glass plates having a size of 25 cm×25 cm were pre-treated each with one of the compositions of CEx. 1, CEx. 2 and Ex. 4. The compositions were sprayed onto the glass plates in an amount of 1-2 g. After having dried the surfaces with a cellulose fabric each of the plates was soiled on one hand by generating two strokes, one with a red and one with a black permanent marker (supplied by Edding) and on the other hand provided with a print of a hand creamed each time with an identical amount of a hand cream (SILONDA® liquid, supplied by Ecolab). Afterwards each of the vertically placed plates was sprayed with about 10 to 30 ml of tap water above the soiling such that the soiling only gets into contact with the water when it runs down the surface and not during the process of spraying the water onto the surface. Thereby, it can be excluded that the soiling is removed from the surface only because of the pressure of the water sprayed against the soiling. Afterwards the plates were allowed to air-dry. The cleaning performance was evaluated visually.

TABLE 6

| | Tap water | CEx. 1 | CEx. 2 | Ex. 4 |
|---|---|---|---|---|
| Removal of edding | None | None | Very little removal | Removal in places |
| Removal of hand print | Lots of drops, complete hand print | Hand print almost complete | Hand print partly removed | Only little residues (from the fingertips) |

As could be expected pre-treatment with water had no influence on the facilitation of a cleaning process subsequent to the pre-treatment. However, the composition which is free of any amphoteric polynitrogen compound shows a low tendency to facilitate the cleaning in a cleaning process subsequent to a pre-treatment. In contrast thereto the presence of amphoteric polyamine (in the inventive composition as well as in the composition of CEx. 2) results in a facilitation of the cleaning if the surface was pre-treated with the corresponding compositions.

Surprisingly, the combination of an amphoteric polynitrogen compound and colloidal silica sol nanoparticles shows an increased effect although the composition of CEx. 1 which contains silica sol nanoparticles but is free of amphoteric polyamine, shows almost no effect. It can be observed very well that each amount of water running over the soiling seems to wash away a part of the soiling without using any pressure or other cleaning means. The effect especially occurs with respect to the removal of the hand print but can also be observed in a minor extent with the edding strokes applied on the glass plates pre-treated with the composition according to the present invention.

The following table 7 shows some acidic compositions which may be used in the present invention (Ex.) and also three comparative compositions (CEx.).

TABLE 7

| | CEx. 1 | CEx. 2 | CEx. 3 | Ex. 1 | Ex. 2 | Ex. 3 | Ex. 4 |
|---|---|---|---|---|---|---|---|
| Water demineralized | 98.47 | 97.97 | 97.97 | 97.45 | 96.97 | 97.45 | 96.97 |
| Lactic acid | 1.0 | 1.0 | 1.0 | — | — | 1.0 | 1.0 |
| Citric acid × 1 $H_2O$ | — | — | — | 1.0 | 1.0 | — | — |
| Isotridecanol, 8 EO[1)] | 0.5 | 0.5 | 0.5 | 0.5 | — | 0.5 | — |
| Isotridecanol, 10 EO[2)] | — | — | — | — | — | — | 1.0 |
| Fatty alcohol ethoxylate, 11 EO[3)] | — | — | — | — | 1.0 | — | — |
| Amphoteric polyamine[4)] | — | 0.5 | — | 0.5 | 0.5 | 0.5 | 0.5 |
| Colloidal silica sol nanoparticles[5)] | — | — | 0.5 | 0.5 | 0.5 | 0.5 | 0.5 |
| Perfume | 0.03 | 0.03 | 0.03 | 0.05 | 0.03 | 0.03 | 0.03 |
| pH value | 2.6 | 2.6 | 2.6 | 2.4 | 2.5 | 2.6 | 2.5 |

[1)]fatty alcohol having 13 carbon atoms, wherein each mole of fatty alcohol is ethoxylated with 8 moles of ethylenoxide

[2)]fatty alcohol having 13 carbon atoms, wherein each mole of fatty alcohol is ethoxylated with 10 moles of ethylenoxide

[3)]fatty alcohol having 10 carbon atoms, wherein each mole of fatty alcohol is ethoxylated with 11 moles of ethylenoxide and the fatty alcohol ethoxylate is end-capped with butyleneoxide

[4)]obtained from polyethylenimine and polyacrylic acid, 40% aqueous solution, supplied by BASF

[5)]aqueous silica sol with a silica content of 30%, a pH value of 10.5 and an average particle size of 7 nm, wherein the silica is organically modified. The product is supplied by Akzo Nobel/Eka Chemicals The above compositions were prepared by adding the single components mentioned to the total amount of water and mixing until an substantially clear solution was obtained. The perfume was added at last. Pre-testing showed that the best performance was obtained with the composition of Ex. 3. Therefore, the following tests were carried out using said composition in comparison with the ones of the comparative examples.

Cleaning Performance

In order to determine the cleaning performance of the compositions CEx. 1, CEx. 2, CEx. 3 and Ex. 3 a gardner test was carried out in a similar manner as described above. However, with the acidic compositions PVC test stripes were used instead of test stripes made of glass. Moreover, the pre-treatment was omitted and the soiling specified above was applied directly onto the stripes. As a further difference the gardner testing device moved the sponge soaked with one of the compositions 10 times from one end of the soiled surface to the other and back. The other parameters are as specified above. The results of the gardner test are shown in table 8.

TABLE 8

| | Tap water | CEx. 1 | CEx. 2 | CEx. 3 | Ex. 3 |
|---|---|---|---|---|---|
| Maximum value | 36 | 55 | 57 | 59 | 59 |
| Minimum value | 24 | 48 | 52 | 52 | 52 |
| Δ (max-min) | 12 | 8 | 5 | 7 | 7 |
| Stand. dev. | 4 | 2 | 2 | 2 | 2 |
| Average | 30 | 51 | 55 | 55 | 55 |

The results in table 8 show that the compositions all show similar cleaning properties which are markedly better than the cleaning properties of pure water. However, the silica sol nanoparticle as well as the amphiprotic polynitrogen compound seem to influence the cleaning properties only very slightly.

Hydrophilizing Effect

In order to determine the hydrophilizing effect, each of the compositions was sprayed in an amount of about 1-1.5 g onto the surface of one of identical ceramic tiles of 20 cm×25 cm size (supplied by Steuler, named Logo). The surface was dried by wiping it with a cellulose fabric. Afterwards the test surfaces were sprayed with tap water and the wetted surfaces were allowed to dry completely. The spray behavior, the behavior of the flowing off the surface (both resulting in the application behavior) as well as the residues after drying (resulting in the behavior of the residue) were determined visually. While evaluating the behavior of the residue the occurrence of reams and bandings was taken into account. To facilitate the visual evaluation the tap water was colored blue. The test was independently carried out and the results independently estimated by five persons for each composition. The results are shown in table 9.

TABLE 9

| | Application Behavior | | | | | Behavior of the Residue | | | | |
|---|---|---|---|---|---|---|---|---|---|---|
| Evaluation | very good | good | medium | bad | very bad | very good | good | medium | bad | very bad |
| CEx. 1 | | | x | | | | | | | x |
| CEx. 2 | | | | x | | | | | x | |
| CEx. 3 | | | x | | | | | x | | |
| Ex. 3 | | x | | | | | x | | | |

The results in table 9 show that all acidic compositions which do not comprise a combination of at least one type of nanoparticles and at least one amphoteric polynitrogen compound show an deteriorated application behavior and result in more reams and bandings in comparison with the composition according to the present invention which comprises both components.

Ability to Dissolve Lime

As acidic cleaners typically are applied to remove lime residues for example occurring in the kitchen, the bath room or any other damp location, the compositions' abilities to dissolve lime were tested. Marble blocks having a size of 30 mm×30 mm×20 mm were brushed while rinsing them with demineralized water. Afterwards the marble blocks were rinsed with ethanol to remove any fatty residues. The marble blocks were dried overnight in a drying oven at a temperature of 90° C. and weighed to result in weight m1. To determine the compositions' ability to dissolve lime the weighed marble blocks were immersed into 200 ml of the composition to be tested and remained there for one hour at room temperature.

Afterwards the marble blocks again were brushed while rinsing them with demineralized water, afterwards rinsed with ethanol, then dried overnight in a drying oven at a temperature of 90° C. and weighed to result in weight m2. The ability mg to dissolve lime in the form of the percentage reduction of the original weight of the marble blocks is obtained using the following equation:

$$mg = \frac{m1 - m2}{m1} \times 100$$

For each composition three marble blocks were used and the average of the three obtained values of mg was determined. The resulting averages are shown in table 10.

TABLE 10

| | Average mg |
|---|---|
| CEx. 1 | 0.3110 |
| CEx. 2 | 0.3180 |
| CEx. 3 | 0.3310 |
| Ex. 3 | 0.3692 |

Surprisingly, it has been found that the composition according to the present invention shows an increased ability to dissolve lime in comparison with the compositions which do not contain any nanoparticles, amphoteric polynitrogen compounds or both.

The invention claimed is:

1. An aqueous composition comprising an amphoteric, organic amine or amide having at least 3 nitrogen atoms and formed by reacting polyethylenimine and polyacrylic acid; and an inorganic nanoparticle selected from the group consisting of amorphous silicon dioxide, silica sols, fumed silica, and mixtures thereof, and sodiummethylglycine diacetate;

wherein the organic amine or amide and the inorganic nanoparticle are present in a 1:1 weight ratio and wherein the composition forms a removable coating when applied to a surface.

2. The composition of claim 1, wherein the silica sola contain colloidal silica particles which are silanized, alumina-modified, or coated with aluminum oxide.

3. The composition of claim 1, wherein the nanoparticle has an average particle size of from 1 to 50 nm.

4. The composition of claim 1 wherein the amine or amide is a polymer.

5. The composition of claim 1 further comprising a surfactant selected from the group consisting of nonionic, anionic, cationic, amphoteric, zwitterionic and mixtures thereof.

6. The composition of claim 5, wherein the surfactant is selected from the group consisting of anionic surfactants, nonionic surfactants and mixtures thereof.

7. The composition of claim 5, wherein the composition does not contain any anionic surfactants if the pH value of the composition is below 7.

8. The composition of claim 1 wherein the nanoparticle is present in an amount from 0.01 to 3 wt. %.

9. The composition of claim 1 wherein the amine or amide is present in an amount from 0.01 to 3 wt. %.

10. The composition of claim 5, wherein the surfactant is present in an amount from 0.01 to 3 wt. %.

11. The composition of claim 1, further comprising from 70 to 99.97 wt. % water.

12. The composition of claim 1, further comprising a compound selected from the group consisting of organic solvents, agents for adjusting the pH value, buffers, perfumes, coloring agents, builders, disinfecting agents, enzymes, bleaching agents, finishing agents, preservatives and mixtures thereof.

13. The composition of claim 1, wherein the nanoparticle is present in an amount from 1.2 to 6 wt. %.

14. The composition of claim 1, wherein the amine or amide is present in an amount from 1.2 to 6 wt. %.

15. The composition of claim 1, wherein the inorganic nanoparticle has a BET surface area from about 200 to about 400 m2/g.

16. An aqueous composition comprising:

colloidal silica nanoparticle;

an amphoteric polyamine having at least 3 nitrogen atoms and obtained by reacting polyethylenimine and polyacrylic acid;

an alcohol having 1-4 carbon atoms;

an alkylene glycol alkyl ether;

a mixture of an amine oxide, a $C_{10}$-$C_{16}$ alkyl sulfonate, and a sulfosuccinate, and sodiummethylglycine, wherein the colloidal silica and the amphoteric polyamine are present in a 1:1 weight ratio.

* * * * *

UNITED STATES PATENT AND TRADEMARK OFFICE

CERTIFICATE OF CORRECTION

PATENT NO. : 8,093,195 B2
APPLICATION NO. : 12/093203
DATED : January 10, 2012
INVENTOR(S) : Uhl et al.

It is certified that error appears in the above-identified patent and that said Letters Patent is hereby corrected as shown below:

Col. 32, line 61, claim 2: "silica sola" should read --silica sols--

Col. 34, line 17, claim 16: "sodiummethylglycine," should read --sodiummethylglycine diacetate,--

Signed and Sealed this
Second Day of October, 2012

David J. Kappos

David J. Kappos
*Director of the United States Patent and Trademark Office*